US008403379B2

(12) United States Patent
Ishiguro et al.

(10) Patent No.: US 8,403,379 B2
(45) Date of Patent: Mar. 26, 2013

(54) DOOR LOCK APPARATUS

(75) Inventors: Katsuyuki Ishiguro, Kanagawa (JP); Takao Taga, Kanagawa (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 612 days.

(21) Appl. No.: 12/370,273

(22) Filed: Feb. 12, 2009

(65) Prior Publication Data

US 2009/0243308 A1 Oct. 1, 2009

(30) Foreign Application Priority Data

Mar. 26, 2008 (JP) ..... 2008-082190

(51) Int. Cl.
*E05C 3/02* (2006.01)
*E05C 3/06* (2006.01)

(52) U.S. Cl. .. 292/201; 292/194; 292/216; 292/DIG. 23

(58) Field of Classification Search ..... 292/194, 292/201, 210, 216, DIG. 23
See application file for complete search history.

(56) References Cited

U.S. PATENT DOCUMENTS 5,054,300 A * 10/1991 Nakahara et al. ..... 70/262
5,474,338 A * 12/1995 Buscher ..... 292/201
5,537,848 A * 7/1996 Grzanka et al. ..... 70/279.1
6,019,402 A * 2/2000 Arabia et al. ..... 292/216
6,145,354 A * 11/2000 Kondo et al. ..... 70/279.1
6,158,788 A * 12/2000 Ikeda et al. ..... 292/216
6,511,106 B2 * 1/2003 Perkins et al. ..... 292/216
6,651,387 B2 * 11/2003 Choi ..... 49/280
7,591,493 B2 9/2009 Nozawa
2002/0056996 A1 * 5/2002 Fukunaga et al. ..... 292/216
2005/0099022 A1 * 5/2005 Wakatsuki ..... 292/336.3

FOREIGN PATENT DOCUMENTS

JP 2004-169416 A 6/2004
JP 3588453 B2 8/2004
KR 10-0886896 B1 2/2009

* cited by examiner

*Primary Examiner* — Thomas Beach
*Assistant Examiner* — Nathan Cumar
(74) *Attorney, Agent, or Firm* — Foley & Lardner LLP

(57) ABSTRACT

A door lock apparatus, at both sides of a region interposing a second link lever therebetween, includes a sector lever shaft and an inside lever shaft that extend in parallel with a swinging shaft of the second link lever. The door lock apparatus also includes an inside handle lever swingably arranged about the inside lever shaft, and when an inside door handle arranged inside a vehicle is open-operated while the second link lever is disposed in a cancel position, moves the second link lever upwards by swinging about the center of the inside lever shaft, and when the inside door handle is open-operated while the second link lever is disposed in a non-cancel position, swings the sector lever in a locked position to an unlocked position about the center of the sector lever shaft, by swinging about the center of the inside lever shaft.

11 Claims, 29 Drawing Sheets

DOOR LOCK APPARATUS

BACKGROUND OF THE INVENTION

1. Field of the Invention

The present invention relates to a door lock apparatus applied to a vehicle, such as a four wheel automobile. More particularly, the present invention relates to a door look apparatus that includes a latch mechanism that, when a door is disposed in a closed position with respect to a vehicle main body, restricts movement of the door in an open direction by being latched.

2. Description of the Related Art

As is know in the art, some of door lock apparatuses include a link lever, a sector lever, and an inside handle lever. The link lever slidably moves between a cancel position and a non-cancel position, and when swung while being disposed in the cancel position, allows a door to move in an open direction by cancelling a latched state of a latch mechanism. When swung while being disposed in the non-cancel position, the link lever maintains the latched state of the latch mechanism. The sector lever is swingably arranged between an unlocked position and a locked position about a sector lever shaft, and disposes the link lever in the cancel position while being in the unlocked position, and disposes the link lever in the non-cancel position while being in the locked position. The inside handle lever is swingably arranged about an inside lever shaft. When an inside door handle arranged inside a vehicle is open-operated while the link lever is disposed in the cancel position, the inside handle lever swings the link lever by swinging about the center of the inside lever shaft. When the inside door handle is open-operated while the link lever is disposed in the non-cancel position, the inside handle lever swings the sector lever in the locked position to the unlocked position, by swinging about the center of the inside lever.

With this type of apparatus, when the inside door handle is open-operated once while the link lever is in the non-cancel position, the link lever is disposed in the cancel position, because the sector lever in the locked position swings to the unlocked position. Accordingly, the latch mechanism is cancelled via the link lever in the cancel position, by open-operating the inside door handle once again. Therefore, even if the link lever is disposed in the non-cancel position, the latch mechanism can be cancelled, only by open-operating the inside door handle, without operating a lock operating member such as an inside lock button arranged inside the vehicle. Accordingly, it is possible to improve operability. Related technology is disclosed in, for example, Japanese Patent No. 3588453.

In the market, reducing the size of the door lock apparatus has been demanded. However, in the door lock apparatus of the related art, depending on the disposition of the inside handle lever, the size of the door lock apparatus may be increased. In other words, because the link lever and the sector lever are swung by swinging the inside handle lever, the size of the inside handle lever may be increased, depending on the disposition.

SUMMARY OF THE INVENTION

It is an object of the present invention to at least partially solve the problems in the conventional technology.

According to an aspect of the present invention, a door lock apparatus includes a latch mechanism that restricts movement of a door in an open direction by latching when the door is in a closed position with respect to a vehicle main body; a link lever that swings between a cancel position and a non-cancel position; a sector lever shaft and an inside lever shaft that are disposed on both sides of the link lever and extend in parallel with a swinging shaft of the link lever; a sector lever that is swingably disposed between an unlocked position and a locked position about the sector lever shaft; and an inside handle lever that is swingably disposed about the inside lever shaft. The link lever allows movement of the door in the open direction by cancelling a latched state of the latch mechanism when moved upwards while being disposed in the cancel position, and maintains the latched state of the latch mechanism when moved upwards while being disposed in the non-cancel position. The sector lever moves the link lever to the cancel position while in the unlocked position, and moves the link lever to the non-cancel position while in the locked position. The inside handle lever moves the link lever upward by swinging about a center of the inside lever shaft when an inside door handle arranged inside a vehicle is open-operated while the link lever is being positioned in the cancel position, and swings the sector lever in the locked position to the unlocked position by swinging about the center of the inside lever shaft when the inside door handle is open-operated while the link lever is being positioned in the non-cancel position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a door lock apparatus according to the present invention are described below in greater detail with reference to the accompanying drawings.

First Embodiment

Figure 1:
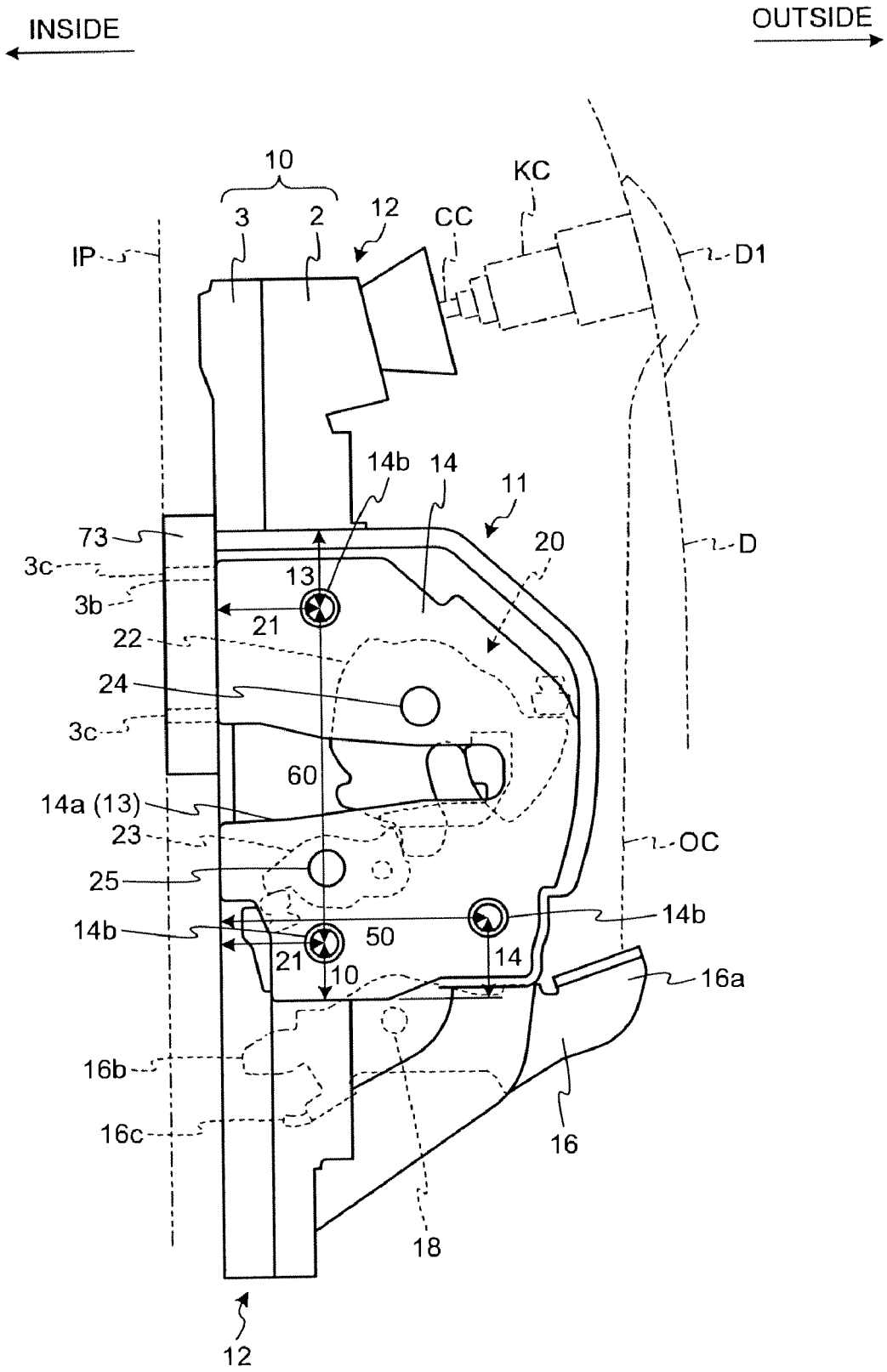
FIG. 1 is a schematic of a door lock apparatus according to a first embodiment of the present invention, viewed from a rear side of a vehicle.
Figure 2:
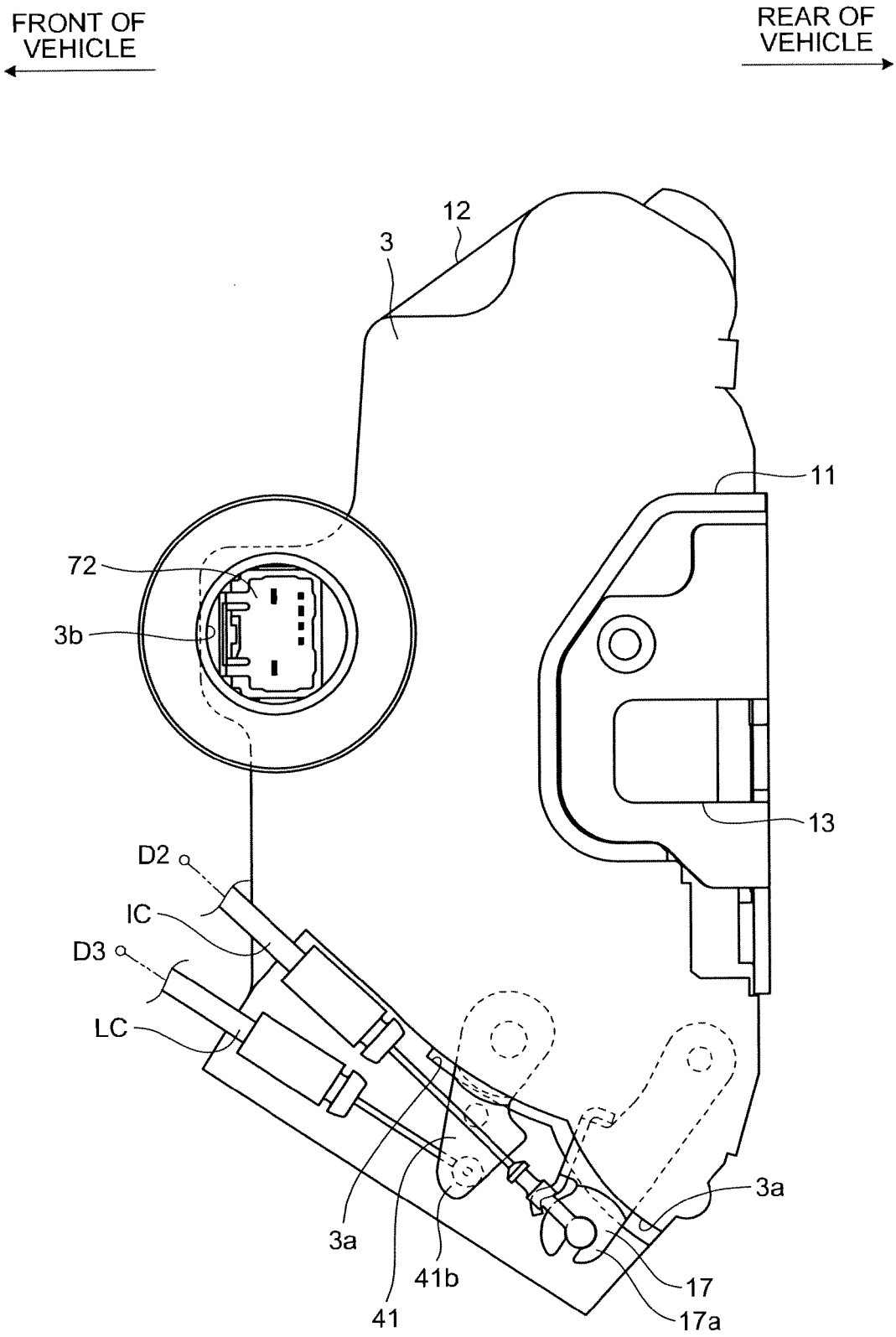
FIG. 2 is a schematic of the door lock apparatus shown in FIG. 1, viewed from the inside of the vehicle.
Figure 3:
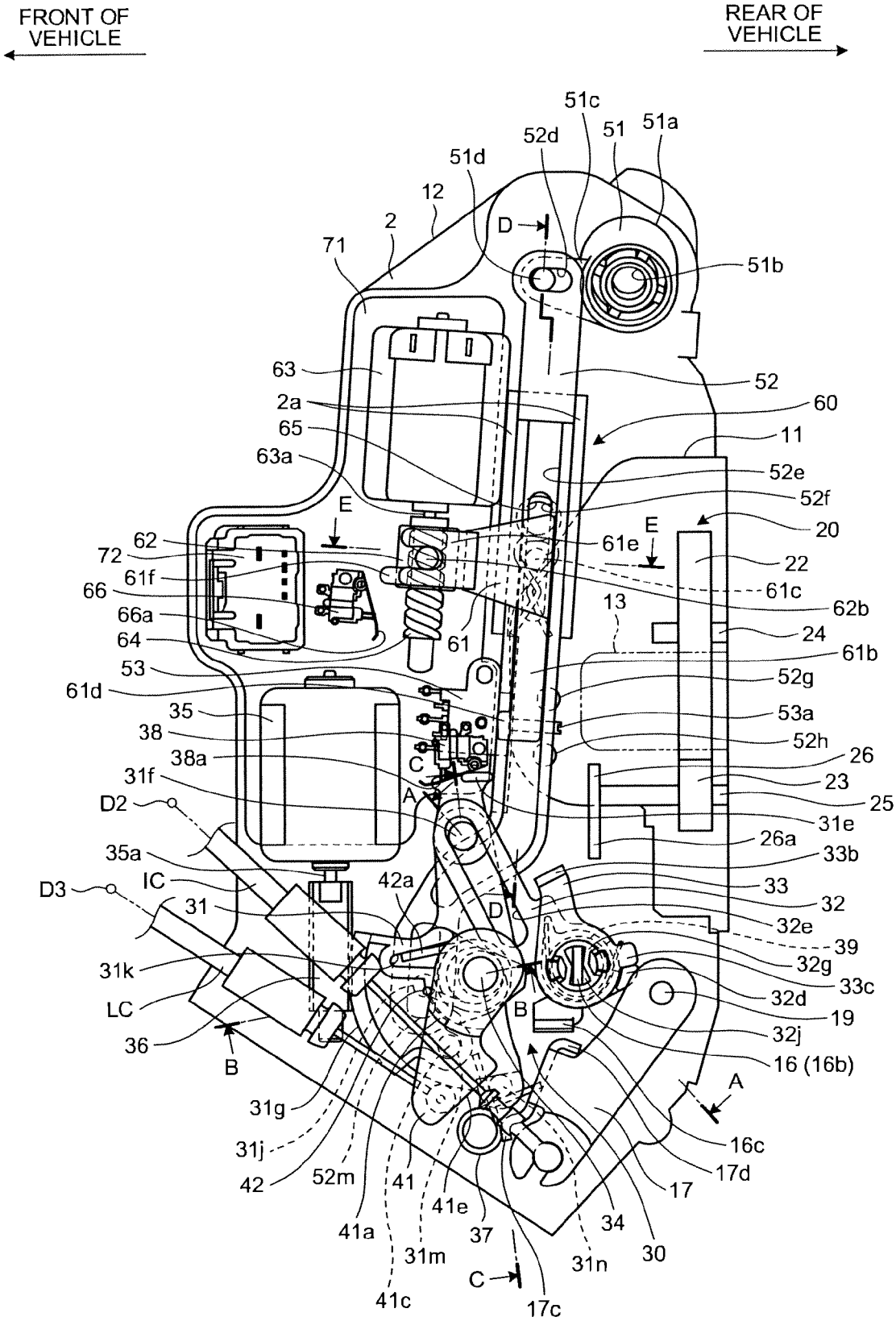
FIG. 3 is a schematic of the door lock apparatus shown in FIG. 1, viewed from the inside of the vehicle after removing a sub case.

FIGS. 1 and 2 are schematics of a door lock apparatus according to a first embodiment of the present invention. FIG. 3 is a schematic of the door lock apparatus shown in FIG. 1 after removing a sub case. The door lock apparatus shown here is provided in a side door (door D at the side of the driver's seat in a right-hand drive vehicle) that has a front hinge disposed at a right front seat of a four-wheel automobile. The door lock apparatus includes a main case 2 and a sub case 3.

The main case 2 and the sub case 3, for example, are respectively molded of synthetic resin, and form a housing 10 by being fastened to each other by a fastening means (not shown) such as a screw, after being connected to each other. A packing material (not shown) is interposed at a connecting portion between the main case 2 and the sub case 3, thereby obtaining a desired water-tightness.

The housing 10 formed by the main case 2 and the sub case 3 includes a latch mechanism accommodating portion 11 and a lock mechanism accommodating portion 12. The latch mechanism accommodating portion 11 extends along the left-right direction of the door D, so as to extend along a facet positioned at the rear side of the vehicle of the door D. The lock mechanism accommodating portion 12 extends along the front-rear direction of the door D, so as to extend along from the end positioned at the inside of the vehicle of the latch mechanism accommodating portion 11 to the inner surface positioned at the inside of the vehicle of the door D. The main case 2 and the sub case 3 exhibit an L-shape when viewed from the above.

The latch mechanism accommodating portion 11 of the housing 10 includes a striker introducing groove 13 that extends substantially horizontally towards the outside of the vehicle from the inside of the vehicle, at substantially the center position in the height direction. The latch mechanism accommodating portion 11 includes a latch mechanism 20 therein.

Figure 4A:
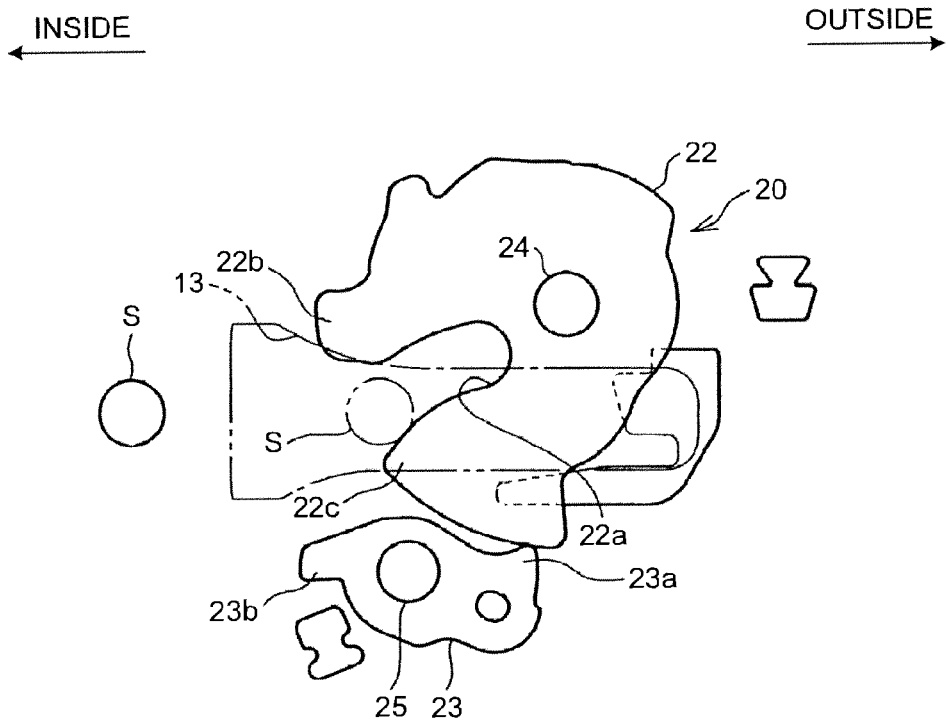
FIG. 4A is a conceptual diagram of a latch mechanism applied to the door lock apparatus shown in FIG. 1, in a door open state.
Figure 4B:
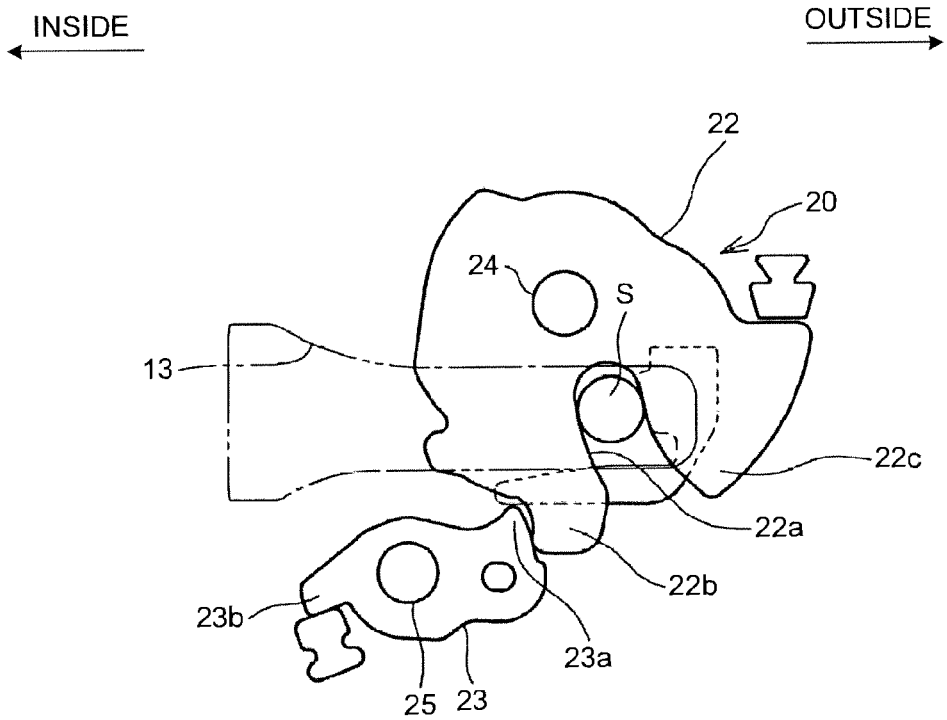
FIG. 4B is a conceptual diagram of the latch mechanism applied to the door lock apparatus shown in FIG. 1, in a latched state.

The latch mechanism 20, as shown in FIGS. 4A and 4B, holds and meshes with a striker S provided at the side of the vehicle main body of the four-wheel automobile. The latch mechanism 20 includes a latch 22 and a ratchet 23.

The latch 22 is rotatably arranged at a position above the striker introducing groove 13 of the latch mechanism accommodating portion 11, about a latch shaft 24 that extends substantially horizontally along the front-rear direction of the vehicle main body. The latch 22 includes a meshing groove 22*a*, a hooking portion 22*b*, and an engaging portion 22*c*.

The meshing groove 22*a* is formed towards the latch shaft 24 from the outer peripheral surface of the latch 22, and formed in a width that can accommodate the striker S.

The hooking portion 22*b* is a portion positioned at the inside of the vehicle than the meshing groove 22*a*, when the meshing groove 22*a* is opened downwards. The hooking portion 22*b*, as shown in FIG. 4A, stops at a position to open the striker introducing groove 13, when the latch 22 is rotated to the maximum clockwise extent about the center of the latch shaft 24. The hooking portion 22*b*, as shown in FIG. 4B, also stops at a position to cut across the striker introducing groove 13, when the latch 22 is rotated to the maximum anti-clockwise extent about the center of the latch shaft 24.

The engaging portion 22*c* is a portion positioned at the outside of the vehicle than the meshing groove 22*a*, when the meshing groove 22*a* is opened downwards. The engaging portion 22*c*, as shown in FIG. 4A, cuts across the striker introducing groove 13 when the latch 22 is rotated to the maximum clockwise extent about the center of the latch shaft 24, and stops in a state that gradually inclines upward toward the back side (outside of vehicle) of the striker introducing groove 13. Although not shown, a latch spring that continuously biases the latch 22 in a clockwise direction about the center of the latch shaft 24 in FIGS. 4A and 4B, is interposed between the latch 22 and the latch mechanism accommodating portion 11.

The ratchet 23 is rotatably arranged at a position below the striker introducing groove 13 of the latch mechanism accommodating portion 11 and inside the vehicle than the latch shaft 24, about a ratchet shaft 25 that extends substantially horizontally along the front-rear direction of the vehicle main body. The ratchet 23 includes an engaging portion 23*a* and an acting portion 23*b*.

The engaging portion 23*a* is a portion that extends outward in a radial direction towards the outside of the vehicle from the ratchet shaft 25. The engaging portion 23*a* can be detachably engaged to the hooking portion 22*b* and the engaging portion 22*c* of the latch 22 via the protruding facet, by rotating about the center of the ratchet shaft 25. The acting portion 23*b* is a portion that extends outward in a radial direction towards the inside of the vehicle from the ratchet shaft 25.

The ratchet 23, as shown in FIG. 3, includes a ratchet lever 26 that, at a position at the front side of the vehicle, integrally rotates with the ratchet 23 about the center of the ratchet shaft 25. The ratchet lever 26 includes an abutting portion 26*a* that extends towards the same direction as the acting portion 23*b* of the ratchet 23 from the ratchet shaft 25. Although not shown, a ratchet spring that continuously biases the ratchet 23 in an anti-clockwise direction about the center of the ratchet shaft 25 in FIGS. 4A and 4B, is provided between the ratchet 23 and the latch mechanism accommodating portion 11.

In the latch mechanism 20 formed as the above, when the door D is in the open state with respect to the vehicle main body, as shown in FIG. 4A, the latch 22 is disposed at an open position to open the striker introducing groove 13. When the door D is moved to a closed position from this state, the striker S provided at the side of the vehicle main body enters the striker introducing groove 13 of the latch mechanism accommodating portion 11. Subsequently, the striker S abuts to the engaging portion 22*c* of the latch 22. As a result, the latch 22 rotates about the center of the latch shaft 24 in an anti-clockwise direction in FIGS. 4A and 4B, against the elastic force of the latch spring (not shown). During this time, the protruding facet of the engaging portion 23*a* slides on the outer peripheral surface of the latch 22, by the elastic force of the ratchet spring (not shown). Accordingly, the ratchet 23 suitably rotates about the center of the ratchet shaft 25 corresponding to the shape of an outer peripheral surface of the latch 22.

When the door D is further moved in the closed direction from the above-mentioned state, an entering amount of the striker S with respect to the striker introducing groove 13 is increased gradually. Subsequently, the engaging portion 23*a* of the ratchet 23 reaches the meshing groove 22*a* of the latch 22. Then, as shown in FIG. 4B, the hooking portion 22*b* of the latch 22 abuts to the engaging portion 23*a* of the ratchet 23, thereby preventing the latch 22 from rotating in a clockwise direction, against the elastic restoring force of the latch spring (not shown). In this state, the hooking portion 22*b* of the latch 22 is disposed at a latch position to cut across the striker introducing groove 13, thereby preventing the striker S from moving towards a disengaging direction from the back side (outside of vehicle) of the striker introducing groove 13 by the hooking portion 22*b*. As a result, the door D is maintained in the closed state with respect to the vehicle main body (latched state).

From the latched state, when the abutting portion 26*a* of the ratchet lever 26 is rotated upwards about the center of the ratchet shaft 25 in FIGS. 4A and 4B, against the elastic force of the ratchet spring (not shown), the abutting/engaging state between the hooking portion 22*b* of the latch 22 and the engaging portion 23*a* of the ratchet shaft 25 is cancelled. Accordingly the latch 22 rotates in a clockwise direction in FIGS. 4A and 4B, by the elastic restoring force of the latch spring (not shown). As a result, as shown in FIG. 4A, the striker introducing groove 13 is opened, and the striker S can move in the disengaging direction from the striker introducing groove 13. Accordingly, the door D can be opened and moved with respect to the vehicle main body.

The latch mechanism accommodating portion 11 of the housing 10, as shown in FIG. 1, includes a cover plate 14 so as to cover the rear side of the vehicle of the latch mechanism accommodating portion 11. The cover plate 14 includes a notch hole 14*a* and a screw hole 14*b*. The notch hole 14*a* is a hole provided so as to expose the striker introducing groove 13 of the latch mechanism accommodating portion 11 to outside from the notch hole 14*a*. The screw hole 14*b* is a hole to fix the housing 10 to the door D via the latch mechanism 20, and there are a plurality of screw holes (three locations in FIG. 1). In the first embodiment, as shown in FIG. 1, the screw hole 14*b* positioned at the upper portion among the screw holes 14*b* is positioned at 13 millimeters from the upper facet and 21 millimeters from the facet at the inside of the vehicle in the latch mechanism accommodating portion 11. The screw hole 14*b* positioned at 60 millimeters below the above-mentioned screw hole 14*b* is positioned at 10 millimeters from the lower facet in the latch mechanism accommodating portion 11. The screw hole 14*b* positioned further outside the vehicle from this screw hole 14*b* is positioned at 14 millimeters from the lower facet and 50 millimeters from the facet at the inside of the vehicle, in the latch mechanism accommodating portion 11.

The lock mechanism accommodating portion 12 of the housing 10, as shown in FIGS. 1 to 3, accommodates therein an open lever 16, an inside handle lever 17, a sector lever 31, and a lock mechanism 30.

The open lever 16 is rotatably arranged at a region further below the ratchet 23 of the latch mechanism 20, about an open lever shaft 18 that extends substantially horizontally along the front-rear direction of the vehicle main body. The open lever 16 includes an open acting end 16*a*, an open operating end 16*b*, and a pressure-receiving portion 16*c*.

The open acting end 16*a* of the open lever 16 is a portion that extends towards the outside of the vehicle from the open lever shaft 18, and the extended end is protruded outside the housing 10. An outside connecting unit OC such as a link that links with an outside door handle D1 arranged at the outer surface of the door D, is connected to a portion that the housing 10 is protruded outside in the open acting end 16*a*. More specifically, when the outside door handle D1 is open-operated, the open lever 16 rotates about the center of the open lever shaft 18 in a clockwise direction in FIG. 1, and the outside connecting unit OC is connected so as the open operating end 16*b* and the pressure-receiving portion 16*c* operate upwards in FIG. 3. The open operating end 16*b* of the open lever 16 is a portion that extends towards the inside of the vehicle from the open lever shaft 18, and disposed at a region below the abutting portion 26*a* in the ratchet lever 26. The pressure-receiving portion 16*c* of the open lever 16 is a portion positioned below the open operating end 16*b*, and bent towards the front of the vehicle from the lower rim of the open lever 16. Although not shown, an open lever spring that continuously biases the open lever 16 about the center of the open lever shaft 18 in an anti-clockwise direction in FIG. 1, is provided between the open lever 16 and the lock mechanism accommodating portion 12.

Figure 5A:
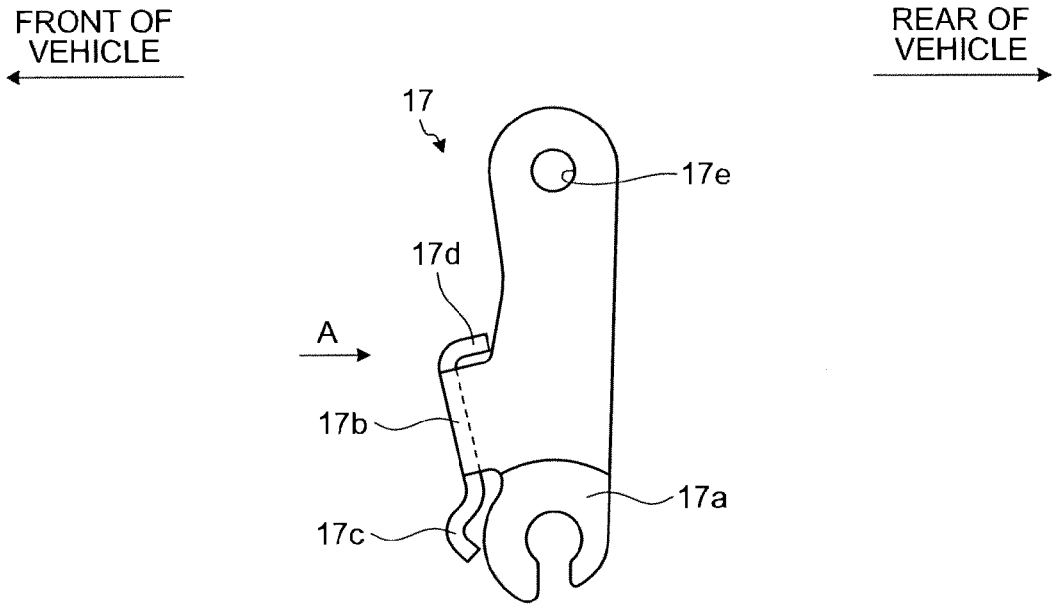
FIG. 5A is a front view of an inside handle lever applied to the door lock apparatus shown in FIG. 1.
Figure 5B:
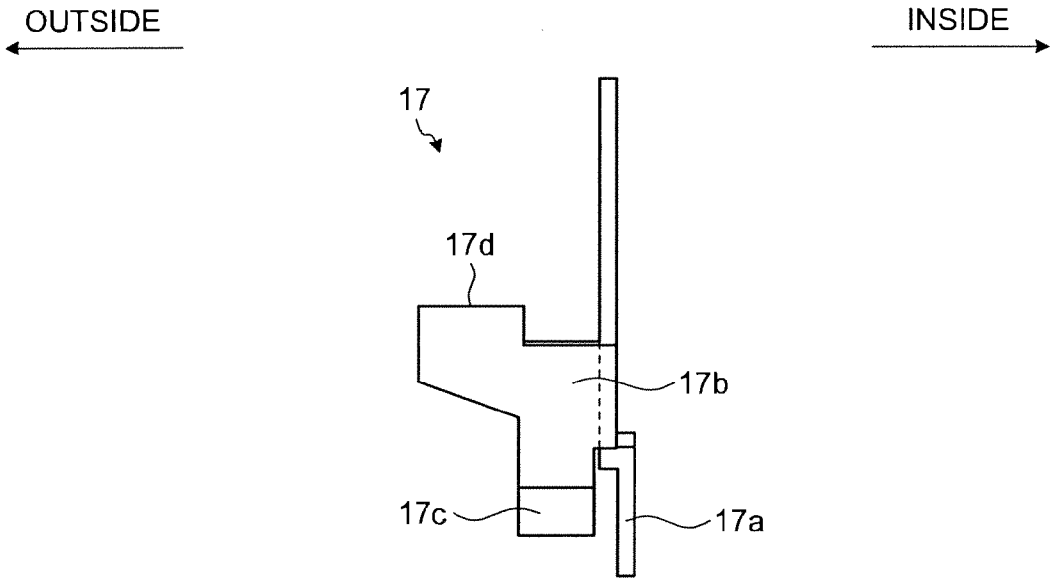
FIG. 5B is a fragmentary view of the inside handle lever shown in FIG. 5A taken in the direction of the arrow A.

The inside handle lever 17 is swingably arranged at a rear region of the vehicle than the open lever 16, about an inside lever shaft 19 that extends substantially horizontally along the left-right direction of the vehicle main body. As shown in FIGS. 5A and 5B, the inside handle lever 17 includes an inside acting end 17*a*, an inside operating end 17*b*, a lock connecting portion 17*c*, an open connecting portion 17*d*, and an inside lever shaft hole 17*e*.

The inside acting end 17*a* is a portion that inclines and extends gradually towards the front of the vehicle, as moving downwards from the inside lever shaft 19. The extended end is exposed to the outside through an opening 3*a* provided at the sub case 3 (see FIG. 2). An inside connecting unit IC such as a link and a cable that links with an inside door handle D2 arranged inside the vehicle, is connected to the portion that the housing 10 is exposed outside in the inside acting end 17*a*. More specifically, when the inside door handle D2 is open-operated, the inside connecting unit IC is connected so as the inside handle lever 17 rotates about the center of the inside lever shaft 19 in a clockwise direction in FIG. 3. The inside operating end 17*b* is a portion that bends toward the outside of the vehicle, after protruding toward the front of the vehicle from the facet positioned at the front side of the vehicle of the inside acting end 17*a*. The lock connecting portion 17*c* is a portion that extends downward from the inside operating end 17*b*. The open connecting portion 17*d* is a portion that bends toward the rear of the vehicle from the outside position of the vehicle than the lock connecting portion 17*c* in the inside operating end 17*b*. As apparent from FIG. 3, the open connecting portion 17*d* is provided so as to closely oppose to the lower surface of the pressure-receiving portion 16*c* in the open lever 16. The inside lever shaft hole 17*e* is a hole to insert the inside lever shaft 19 therethrough.

Figure 6A:
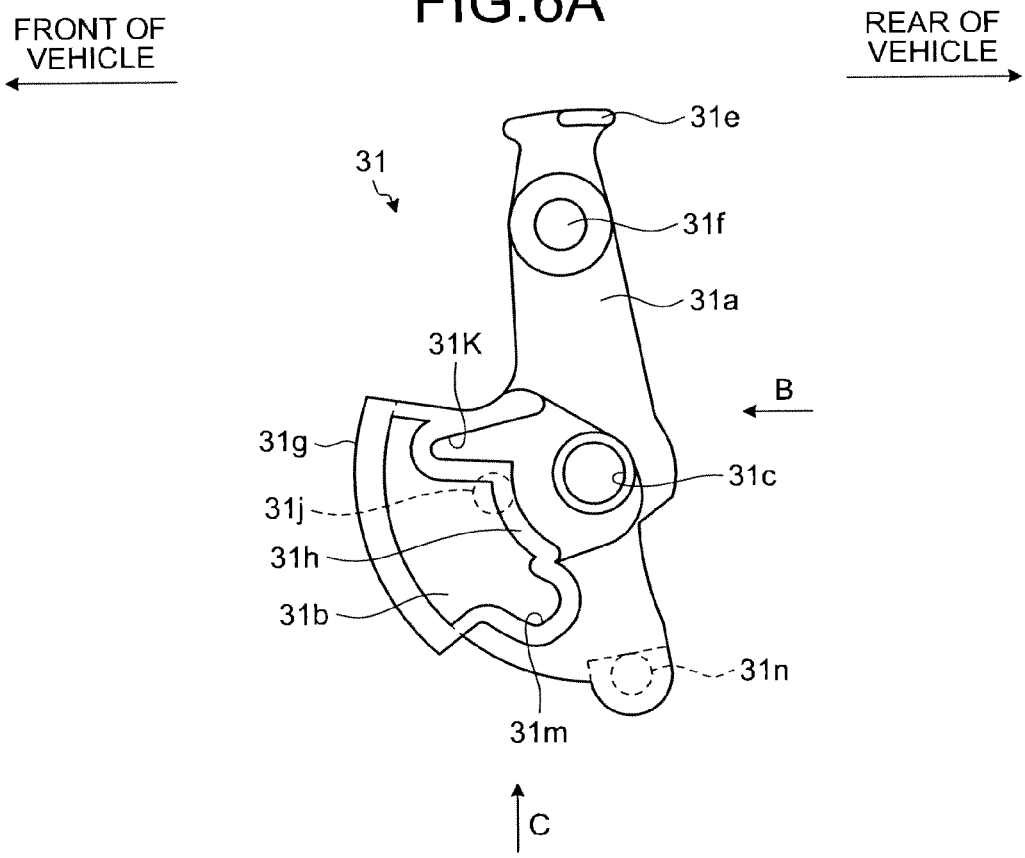
FIG. 6A is a front view of a sector lever applied to the door lock apparatus shown in FIG. 1.
Figure 6B:
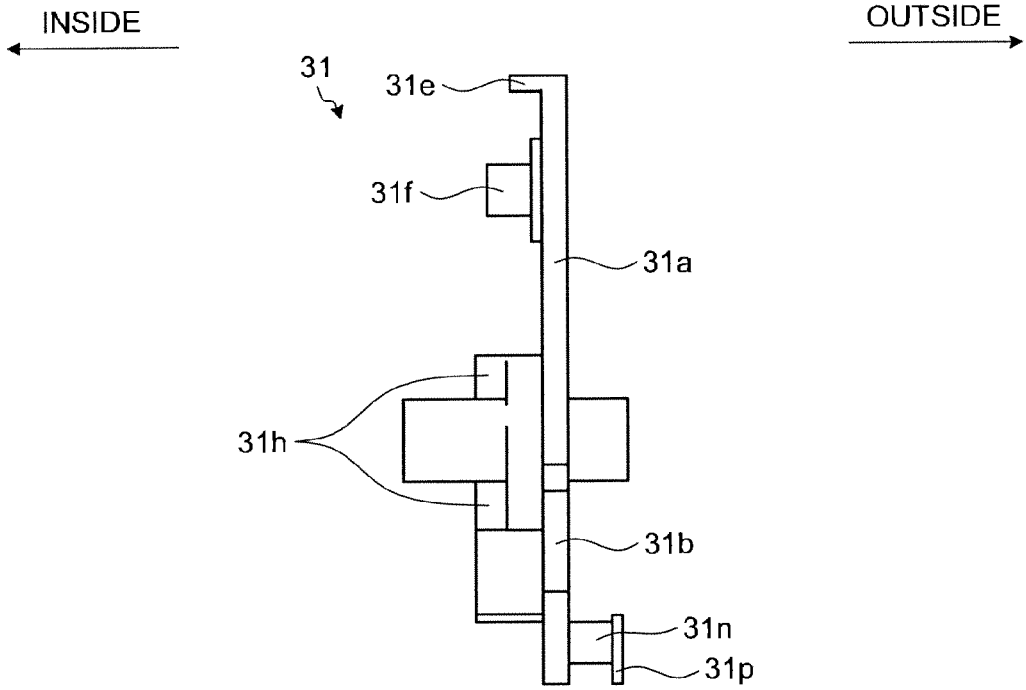
FIG. 6B is a fragmentary view of the sector lever shown in FIG. 6A taken in the direction of the arrow B.
Figure 6C:
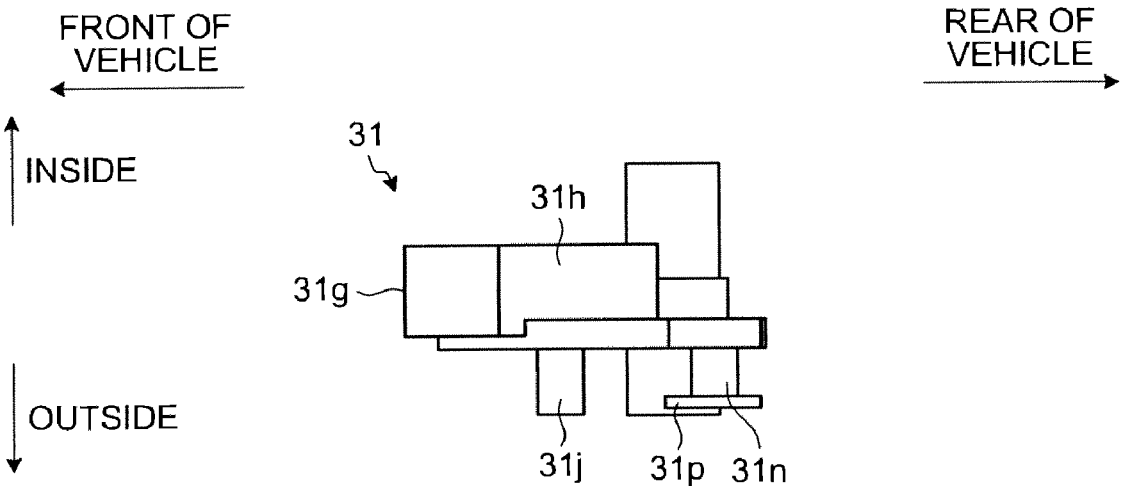
FIG. 6C is a fragmentary view of the sector lever shown in FIG. 6A taken in the direction of the arrow C.

The sector lever 31 is swingably arranged at a front region of the vehicle than the open lever 16, about a sector lever shaft 34 that extends substantially horizontally along the left-right direction of the vehicle main body. The sector lever 31 includes a sector portion that expands the opening gradually towards the front of the vehicle. The sector lever 31, as shown in FIGS. 6A, 6B, and 6C, includes a transmitting end 31*a*, an operating end 31*b*, and a sector lever shaft hole 31*c*.

The transmitting end 31*a* is a portion that extends upward from the sector lever shaft 34, and includes a block protrusion 31*e* and a connecting pin 31*f*. The block protrusion 31*e* is a portion projected towards the inside of the vehicle from the upper rim in the transmitting end 31*a*. The connecting pin 31*f* is a columnar protrusion that extends substantially horizontally along the left-right direction of the vehicle main body from the facet positioned at the inside of the vehicle, at a region below the block protrusion 31*e* in the transmitting end 31*a*.

The operating end 31*b* is a portion made in a substantially fan-shape integrally formed with a portion that extends towards the front of the vehicle from the sector lever shaft 34 and a portion that extends downward from the sector lever shaft 34. The operating end 31*b* includes a gear portion 31*g*, an accommodating wall 31*h*, a key operating pin 31*j*, and a locking pin 31*n*. The gear portion 31*g* is a gear formed at an outer peripheral surface of the operating end 31*b* in an arc, and meshed with a worm 36 fixed to an output shaft 35*a* of an electric motor 35 (see FIG. 3). The accommodating wall 31*h* is a portion projected towards the inside of the vehicle in the operating end 31*b*. The accommodating wall 31*h* includes a spring operating groove 31*k* and a pin operating groove 31*m*. The spring operating groove 31*k* is curved so as to open toward the rear of the vehicle in the accommodating wall 31*h*. The pin operating groove 31*m* is curved at the region below the spring operating groove 31*k* in the accommodating wall 31*h*, so as to open about the center of the sector lever shaft 34 in an anti-clockwise direction. The key operating pin 31*j* is a columnar protrusion that extends substantially horizontally along the left-right direction of the vehicle main body, from the facet positioned at the outside of the vehicle in the operating end 31*b*. The locking pin 31*n* is a columnar protrusion that extends substantially horizontally along the left-right direction of the vehicle main body, from the facet positioned at the outside of the vehicle, at the lower region of the operating end 31*b*. A stopper 31*p* that has a larger outer diameter than the locking pin 31*n* is formed on the extended end of the locking pin 31*n*. The sector lever shaft hole 31*c* is a hole to insert the sector lever shaft 34 therethrough.

The lock mechanism 30 is formed so as to switch between an unlocked state and a locked state. The unlocked state transmits the rotation of the open lever 16 by the open-operation of the outside door handle D1 to the latch mechanism 20, corresponding to the position of the sector lever 31. The locked state does not transmit the rotation of the open lever 16 by the open-operation of the outside door handle D1 to the latch mechanism 20. The lock mechanism 30 includes a first link lever 32 and a second link lever (link lever of the present invention) 33.

Figure 7A:
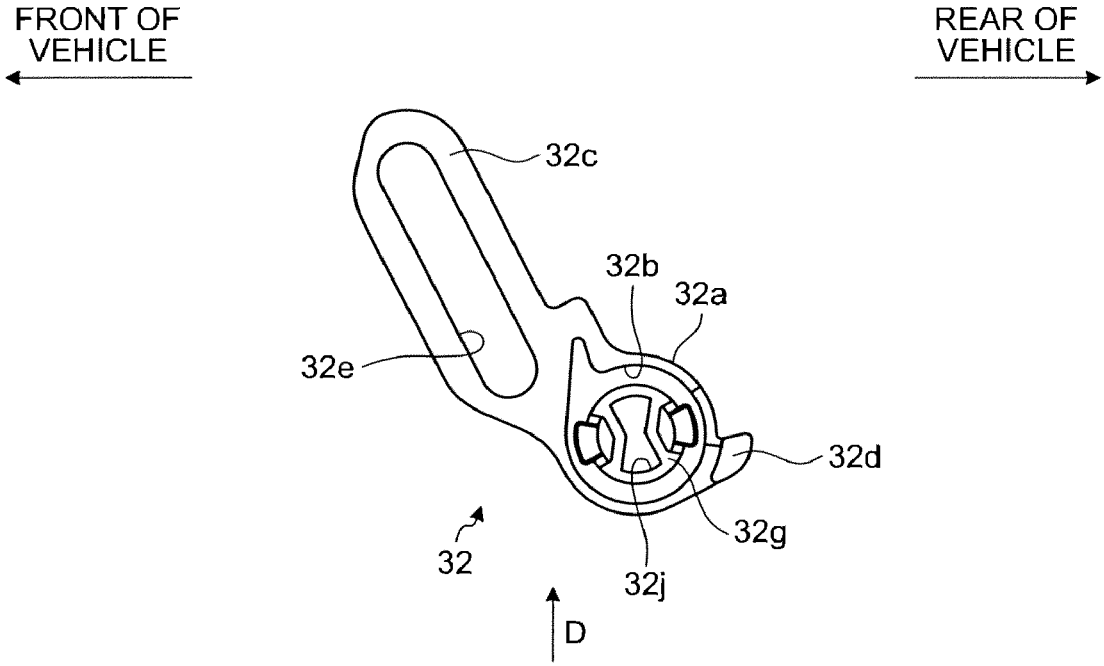
FIG. 7A is a front view of a first link lever applied to the door lock apparatus shown in FIG. 1.
Figure 7B:
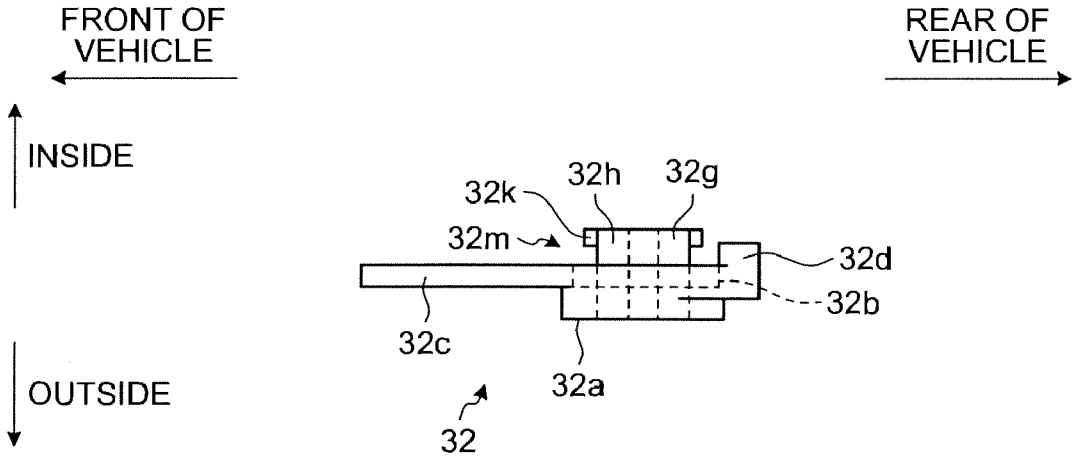
FIG. 7B is a fragmentary view of the first link lever shown in FIG. 7A taken in the direction of the arrow D.

The first link lever 32, as shown in FIGS. 7A and 7B, is a lever member in which a connecting tool 32*g* is mounted on substantially the center of a link main body 32*a*. The connecting tool 32*g* includes a connecting tool main body 32*h*, a fitting hole 32*j*, and a pair of fitting pawls 32*k*. The connecting tool main body 32*h* is a cylinder mounted on a connecting hole (not shown) of the link main body 32*a* via the outer peripheral surface. The fitting hole 32*j* is provided inside the connecting tool main body 32*h*. The pair of fitting pawls 32*k* is formed so as to protrude outwards in a radial direction from a peripheral surface of the end positioned at the inside of the vehicle of the connecting tool main body 32*h*. The first link lever 32 is vertically movably supported with the open operating end 16*b* and the pressure-receiving portion 16*c*, and swingably supported about the center of the open operating end 16*b* along the left-right direction of the vehicle main body. This is enabled by keeping the open operating end 16*b* of the open lever 16 inserted through the fitting hole 32*j* of the connecting tool 32*g* (see FIG. 3). The first link lever 32 includes a spring accommodating groove 32*b*, a sector connecting portion 32*c*, and a lever abutting portion 32*d*. The spring accommodating groove 32*b* is a substantially circular groove formed so as to surround the connecting tool main body 32*h* of the connecting tool 32*g*, at the inside region of the vehicle in the link main body 32*a*. The sector connecting portion 32*c* is a portion that inclines forward and extends from the front region of the vehicle in the link main body 32*a* in FIG. 3, and includes a connecting groove hole 32*e*. The connecting groove hole 32*e* is a slit opening formed along the extending direction of the sector connecting portion 32*c*, and as apparent from FIG. 3, movably fits and supports the connecting pin 31*f* of the sector lever 31 therein. The lever abutting portion 32*d* is a portion that bends toward the inside of the vehicle, after protruding towards the rear of the vehicle from the rear region of the vehicle in the link main body 32*a*.

Figure 8A:
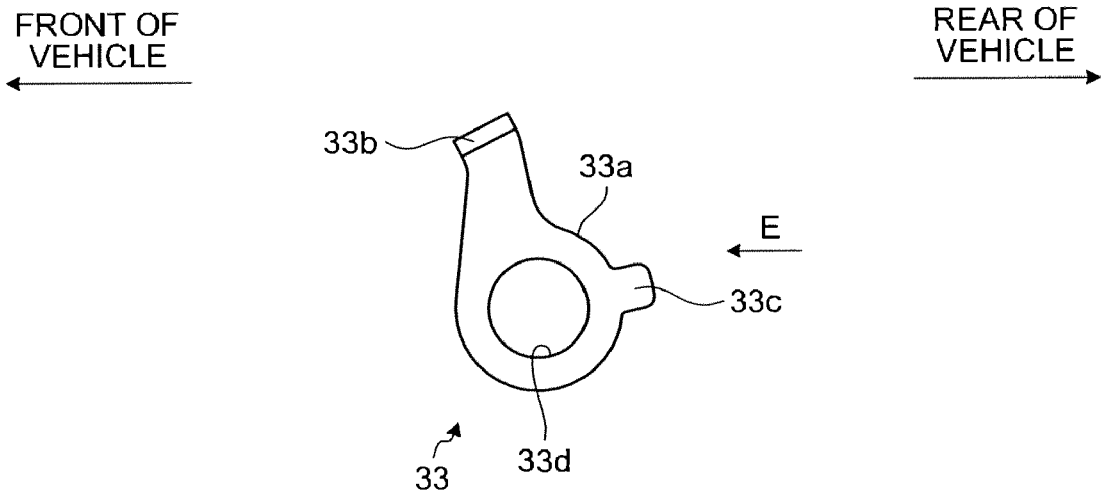
FIG. 8A is a front view of a second link lever applied to the door lock apparatus shown in FIG. 1.
Figure 8B:
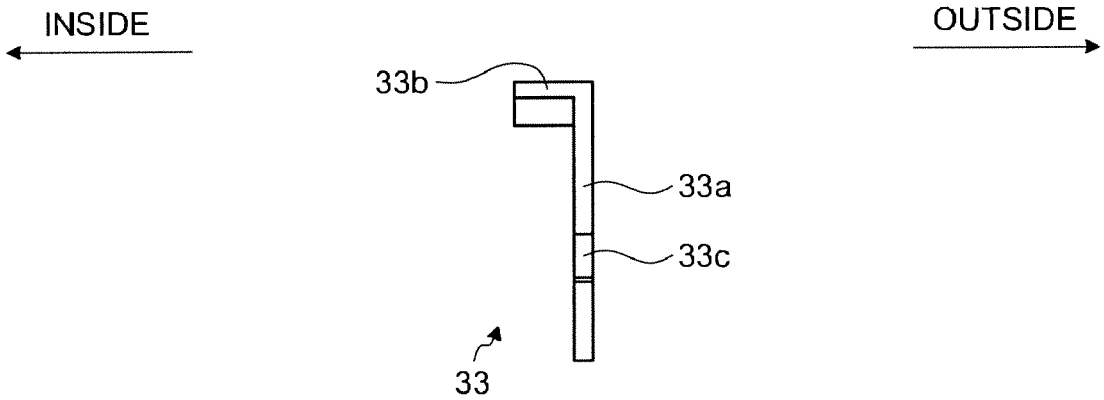
FIG. 8B is a fragmentary view of the second link lever shown in FIG. 8A taken in the direction of the arrow E.

The second link lever 33, as shown in FIG. 3, is a lever member swingably arranged about the center of the connecting tool 32*g* along the left-right direction of the vehicle main body, between the first link lever 32 and the sub case 3, so as to overlap with the link main body 32*a* of the first link lever 32. The second link lever 33 is vertically movably formed with the connecting tool 32*g* mounted on the first link lever 32. The second link lever 33, as shown in FIGS. 8A and 8B, includes a ratchet driving portion 33*b*, a locking portion 33*c*, and a connecting tool main body hole 33*d* on a lever main body 33*a*. The ratchet driving portion 33*b* is a portion that bends and extends towards the inside of the vehicle, after extending upward from the upper region of the lever main body 33*a*. The ratchet driving portion 33*b* is an abutting/engaging portion formed on the lever main body 33*a*. When disposed vertically above the connecting tool 32*g* mounted on the first link lever 32 (see FIG. 18), the ratchet driving portion 33*b* is formed so as to closely oppose to the lower facet of the abutting portion 26*a* in the ratchet lever 26. The locking portion 33*c* is a portion that extends towards the rear of the vehicle, from the rear region of the vehicle in the lever main body 33*a*. As apparent from FIG. 3, the lower facet of the locking portion 33*c* is abutted to the upper facet of the lever abutting portion 32*d* of the first link lever 32. The connecting tool main body hole 33*d* is a hole to insert the connecting tool main body 32*h* of the connecting tool 32*g* mounted on the first link lever 32 therethrough.

When the second link lever 33 is being arranged, falling is prevented by fitting the rim of the connecting tool main body hole 33*d* to a fitting groove 32*m* (see FIG. 7B) formed by the link main body 32*a*, the connecting tool main body 32*h*, and the pair of fitting pawls 32*k* of the first link lever 32.

As apparent from FIG. 3, the sector lever shaft 34 and the inside lever shaft 19 are disposed at both sides of a region interposing the second link lever 33 therebetween.

Figure 18:
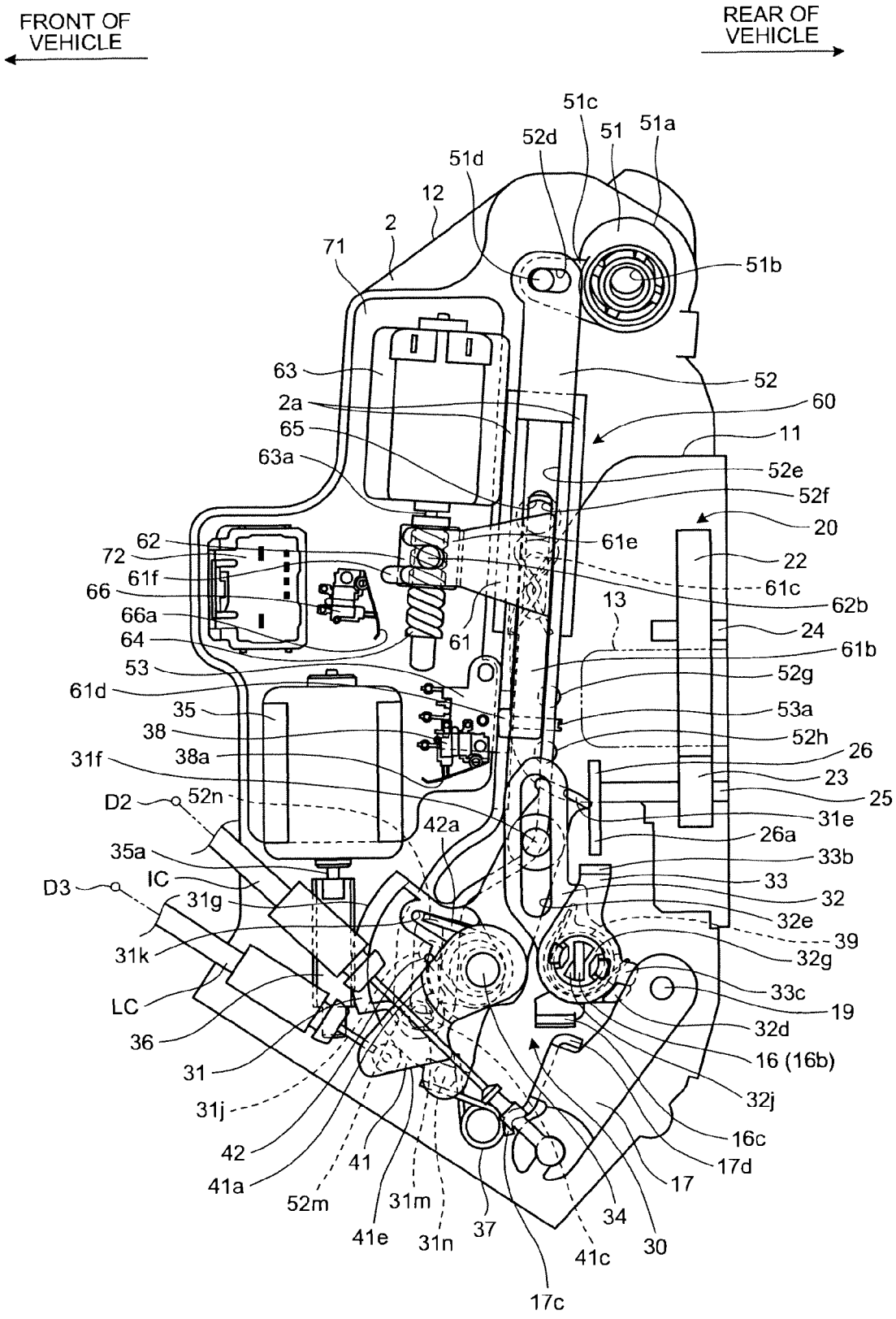
FIG. 18 is a schematic of the door lock apparatus shown in FIG. 1, when a lock mechanism is in an unlocked state.

As shown in FIG. 3, an over-center spring 37 is provided at the lower portion of the sector lever 31, and a lock switch 38 is arranged in the upper portion of the sector lever 31. The over-center spring 37 holds the sector lever 31 about the center of the sector lever shaft 34 via the locking pin 31*n*. More specifically, the over-center spring 37 holds the sector lever 31 either at a position where, as shown in FIG. 18, the sector lever 31 is swung about the center of the sector lever shaft 34 to the maximum clockwise extent (unlocked position) or at a position where, as shown in FIG. 3, the sector lever 31 is swung about the center of the sector lever shaft 34 to the maximum anti-clockwise extent (locked position). The lock switch 38 detects whether the sector lever 31 is in the locked position, corresponding to the contact state of the block protrusion 31*e* of the sector lever 31 with respect to a detection piece 38*a*.

Figure 13:
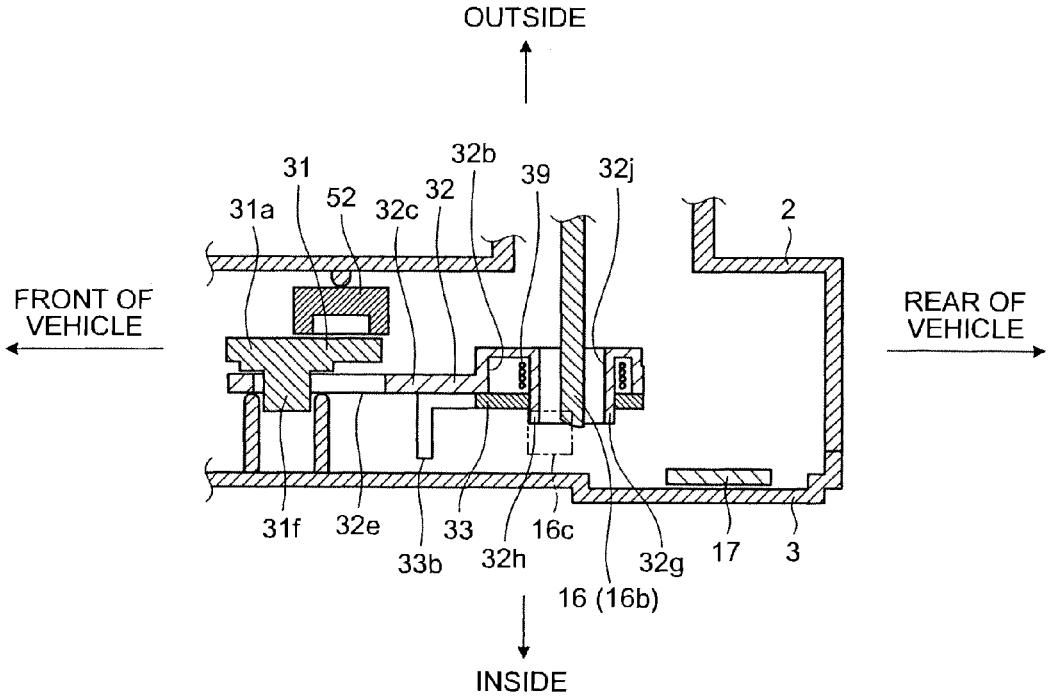
FIG. 13 is a sectional view taken along a line A-A in FIG. 3.

As shown in FIGS. 3 and 13, a panic spring 39 is provided between the first link lever 32 and the second link lever 33. The panic spring 39 continuously biases the lever abutting portion 32*d* of the link main body 32*a* and the locking portion 33*c* of the lever main body 33*a* so as to abut to each other. The panic spring 39 is supported by the connecting tool main body 32*h* of the connecting tool 32*g* mounted on the first link lever 32, and also accommodated in the spring accommodating groove 32*b*.

With the lock mechanism 30 formed as the above, the state shown in FIG. 18 is the unlocked state. In the unlocked state, the sector lever 31 is disposed in the unlocked position and the ratchet driving portion 33*b* of the second link lever 33 is disposed vertically above the connecting tool 32*g* mounted on the first link lever 32 (cancel position). Accordingly, the ratchet driving portion 33*b* is closely opposed to the lower facet of the abutting portion 26*a* in the ratchet lever 26. Therefore, when the outside door handle D1 is open-operated from this state, and the link main body 32*a* of the first link lever 32 moves upwards by the rotation of the open lever 16, the ratchet driving portion 33*b* of the second link lever 33 abuts to the abutting portion 26*a* of the ratchet lever 26 in the latch mechanism 20, thereby moving the latch mechanism 20 upwards. As a result, even if the latch mechanism 20 is in the latched state, the latched state is cancelled, thereby enabling to open and move the door D with respect to the vehicle main body.

From the unlocked state shown in FIG. 18, when the electric motor 35 is driven and the worm 36 is suitably rotated in any direction, the sector lever 31 swings about the sector lever shaft 34 in an anti-clockwise direction. As a result, the first link lever 32 engaged via the connecting pin 31*f* and the second link lever 33 that abuts to the lever abutting portion 32*d* swing about the fitting hole 32*j* in an anti-clockwise direction. Accordingly, the lock mechanism 30 is turned in the locked state shown in FIG. 3.

In the locked state, the sector lever 31 is disposed in the locked position, and the ratchet driving portion 33*b* of the second link lever 33 deviates from the position opposed to the lower facet of the abutting portion 26*a* in the ratchet lever 26 (non-cancel position). Accordingly, even if the outside door handle D1 is open-operated, and the link main body 32*a* of the first link lever 32 moves upwards by the rotation of the open lever 16, the ratchet driving portion 33*b* does not abut to the abutting portion 26*a* of the ratchet lever 26 in the latch mechanism 20. As a result, the open-operation of the outside door handle D1 is invalidated, and when the latch mechanism 20 is in the latched state, the latched state is maintained. Accordingly, the door D is maintained in the closed position with respect to the vehicle main body.

From the locked state shown in FIG. 3, when the electric motor 35 is driven and the worm 36 is suitably rotated in any direction, the sector lever 31 swings about the sector lever shaft 34 in a clockwise direction. As a result, the first link lever 32 engaged via the connecting pin 31*f* and the second link lever 33 biased by the panic spring 39 swing about the fitting hole 32*j* in a clockwise direction. Accordingly, the lock mechanism 30 returns again to the unlocked state shown in FIG. 18.

The door lock apparatus, as shown in FIG. 3, also includes a lock lever 41 that operates when a lock knob D3 arranged inside the vehicle is locked, in the lock mechanism accommodating portion 12.

Figure 9A:
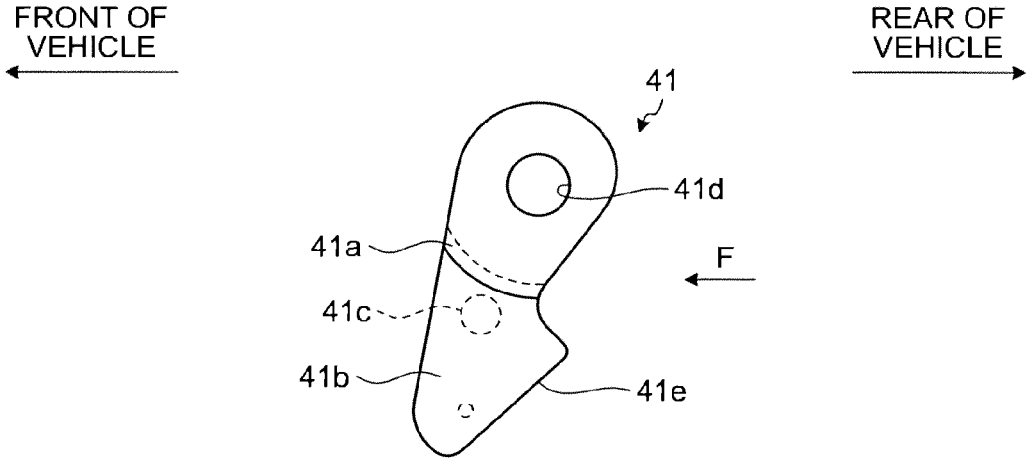
FIG. 9A is a front view of a lock lever applied to the door lock apparatus shown in FIG. 1.
Figure 9B:
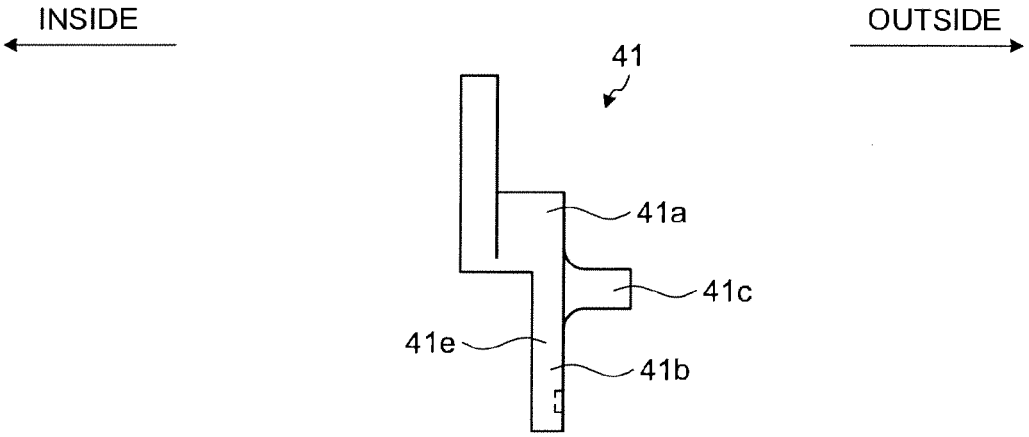
FIG. 9B is a fragmentary view of the lock lever shown in FIG. 9A taken in the direction of the arrow F.

The lock lever 41, as shown in FIG. 3, is swingably arranged about the sector lever shaft 34, between the sector lever 31 and the sub case 3 so as to overlap with the sector lever 31. As shown in FIGS. 9A and 9B, the lock lever 41 includes a spring connecting portion 41*a*, a lock acting end 41*b*, a lock operating pin 41*c*, and a sector lever shaft hole 41*d*.

The spring connecting portion 41*a* is a portion that bends and extends towards the outside of the vehicle, after extending downward from the sector lever shaft 34 in FIG. 3. The lock acting end 41*b* is a portion that bends and extends downward from the end positioned at the outside of the vehicle of the spring connecting portion 41*a*, and the extended end is exposed outside through the opening 3*a* provided at the sub case 3 (see FIG. 2). A lock connecting unit LC such as a link and a cable that links with the lock knob D3 arranged inside the vehicle, is connected to the portion that the housing 10 is exposed outside in the lock acting end 41*b*. More specifically, when the lock knob D3 is locked in a predetermined manner while the lock mechanism 30 is in the unlocked state, the lock connecting unit LC is connected so that the lock lever 41 swings about the center of the sector lever shaft 34 in an anti-clockwise direction in FIG. 18. The lock operating pin 41*c* is a columnar protrusion that extends substantially horizontally along the left-right direction of the vehicle main body, from the facet positioned at the outside of the vehicle in the lock acting end 41*b*. The lock operating pin 41*c*, as shown in FIG. 18, is disposed at the pin operating groove 31*m* of the accommodating wall 31*h* formed in the sector lever 31. When the lock lever 41 swings about the center of the sector lever shaft 34 in an anti-clockwise direction in FIG. 18, the lock operating pin 41*c* is formed so as to press the accommodating wall 31*h* that forms the back side (lower portion in FIG. 18) of the pin operating groove 31*m*. The sector lever shaft hole 41*d* is a hole to insert the sector lever shaft 34 therethrough.

The lock acting end 41*b* includes an inside abutting surface 41*e*. The inside abutting surface 41*e*, as shown in FIG. 3, when the lock acting end 41*b* is disposed at the region below the sector lever shaft 34, is formed so as to incline and extend gradually towards the rear side of the vehicle as moving upwards from the lower facet of the lock acting end 41*b*. The inside abutting surface 41*e*, when the lock mechanism 30 is in the locked state, as shown in FIG. 3, is disposed in the swinging range when the lock connecting portion 17*c* of the inside handle lever 17 swings about the inside lever shaft 19. At the same time, the inside abutting surface 41*e*, when the lock mechanism 30 is in the unlocked state, as shown in FIG. 18, is disposed at a position separated from the lock connecting portion 17*c*.

In the present first embodiment, the lock knob D3 is retractably arranged in the inside of the vehicle and formed so as to protrude inside the vehicle only when the lock mechanism 30 is in the unlocked state. Accordingly, it is possible to lock by deeply inserting the lock knob D3 therein.

Figure 15:
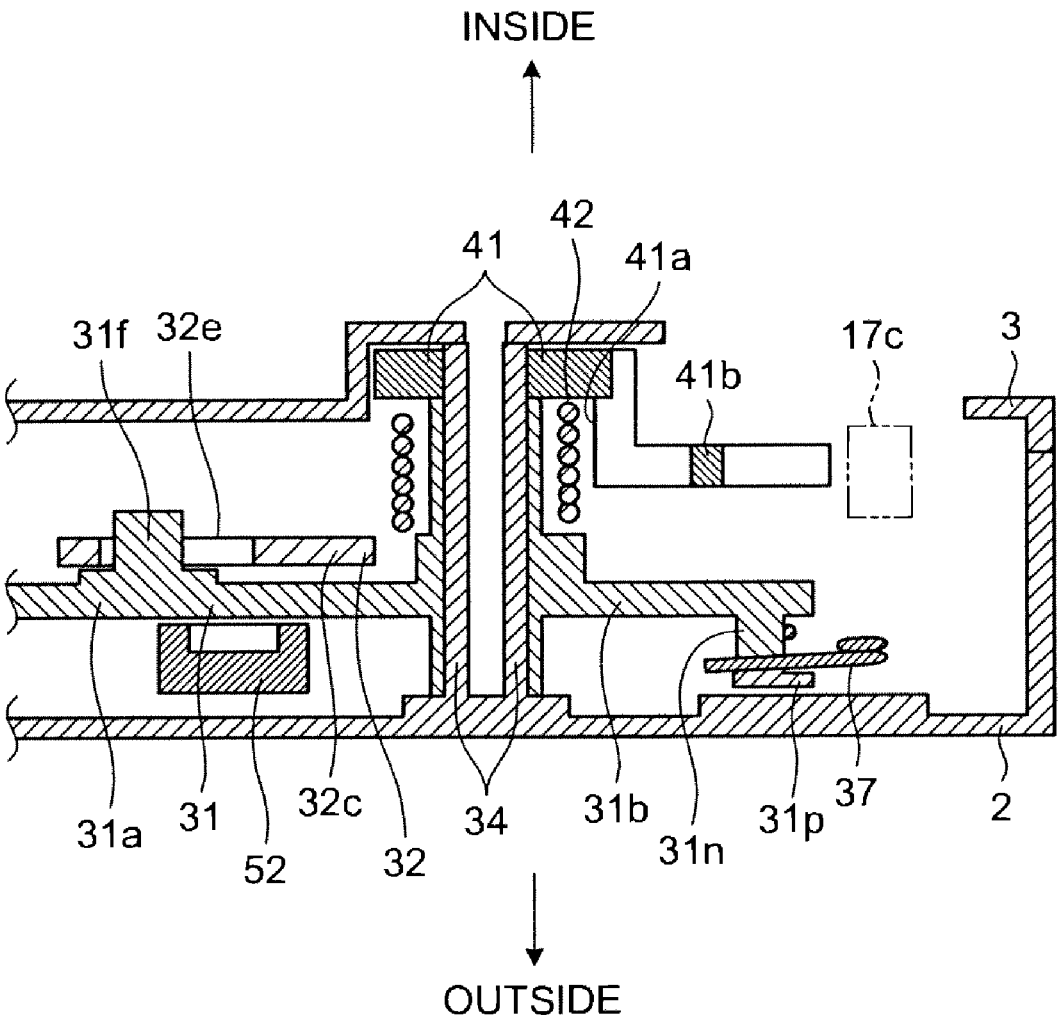
FIG. 15 is a sectional view taken along a line C-C in FIG. 3.

As shown in FIGS. 3 and 15, a connecting spring 42 is provided between the lock lever 41 and the sector lever 31. The connecting spring 42 continuously biases the spring connecting portion 41*a* of the lock lever 41 and the accommodating wall 31*h* of the sector lever 31 so as to integrally operate, about the sector lever shaft 34 in a clockwise direction. The connecting spring 42 is arranged about the sector lever shaft 34 of the sector lever 31, and includes a spring acting portion 42*a*. The spring acting portion 42*a* is a portion disposed at the spring operating groove 31*k* of the accommodating wall 31*h* formed at the sector lever 31. The spring acting portion 42*a* is formed so as to press the accommodating wall 31*h* that forms the upper portion of the spring operating groove 31*k* (see FIG. 3), about the sector lever shaft 34 in a clockwise direction, by the elastic restoring force of the connecting spring 42. The spring acting portion 42*a* is formed so that a biasing force that biases the accommodating wall 31*h* that forms the upper portion of the spring operating groove 31*k* in the sector lever 31 (see FIG. 3), about the center of the sector lever shaft 34 in a clockwise direction, becomes smaller than a holding force of which the over-center spring 37 holds the sector lever 31 to a locked position about the center of the sector lever shaft 34.

It is not always necessary to drive the electric motor 35 to shift the lock mechanism 30 in the unlocked state shown in FIG. 18 to the locked state shown in FIG. 3, but it is also possible by locking the lock knob D3. In other words, from the unlocked state shown in FIG. 18, when the lock lever 41 is swung about the center of the sector lever shaft 34 in an anti-clockwise direction by locking the lock knob D3, the lock operating pin 41*c* presses the accommodating wall 31*h* that forms the back side (lower portion in FIG. 18) of the pin operating groove 31*m* of the sector lever 31. When the lock operating pin 41*c* of the lock lever 41 presses the accommodating wall 31*h* that forms the back side of the pin operating groove 31*m* of the sector lever 31, the sector lever 31 swings about the sector lever shaft 34 in an anti-clockwise direction, while suitably rotating the worm 36. As a result, the sector lever 31 is disposed in the locked position, and the first link lever 32 engaged via the connecting pin 31*f* and the second link lever 33 that abuts to the lever abutting portion 32*d* swing about the fitting hole 32*j* in an anti-clockwise direction. Accordingly, the lock mechanism 30 is turned in the locked state shown in FIG. 3.

When the inside door handle D2 is open-operated from the unlocked state shown in FIG. 18, the open connecting portion 17*d* of the inside handle lever 17 moves upwards. Accordingly, the first link lever 32 and the second link lever 33 also move upwards, via the pressure-receiving portion 16*c* of the open lever 16. Therefore, the second link lever 33 abuts to the abutting portion 26*a* of the ratchet lever 26 in the latch mechanism 20, thereby canceling the latched state. In other words, the door D can be opened and moved by the open-operation of the inside door handle D2.

In the locked state shown in FIG. 3, the inside abutting surface 41*e* provided at the lock acting end 41*b* of the lock lever 41 is disposed in the swinging range of the lock connecting portion 17*c* in the inside handle lever 17. When the inside door handle D2 is open-operated from this state, the first link lever 32 and the second link lever 33 move upwards, because the open connecting portion 17*d* in the inside handle lever 17 also moves. At the same time, the lock connecting portion 17*c* abuts to the inside abutting surface 41*e* of the lock lever 41, thereby swinging the lock lever 41 about the center of the sector lever shaft 34 in a clockwise direction. When the inside door handle D2 is open-operated once, the lock lever 41 swings to the state shown in FIG. 20 from the state shown in FIG. 3, via the state shown in FIG. 19. The operation will now be described in detail.

Figure 19:
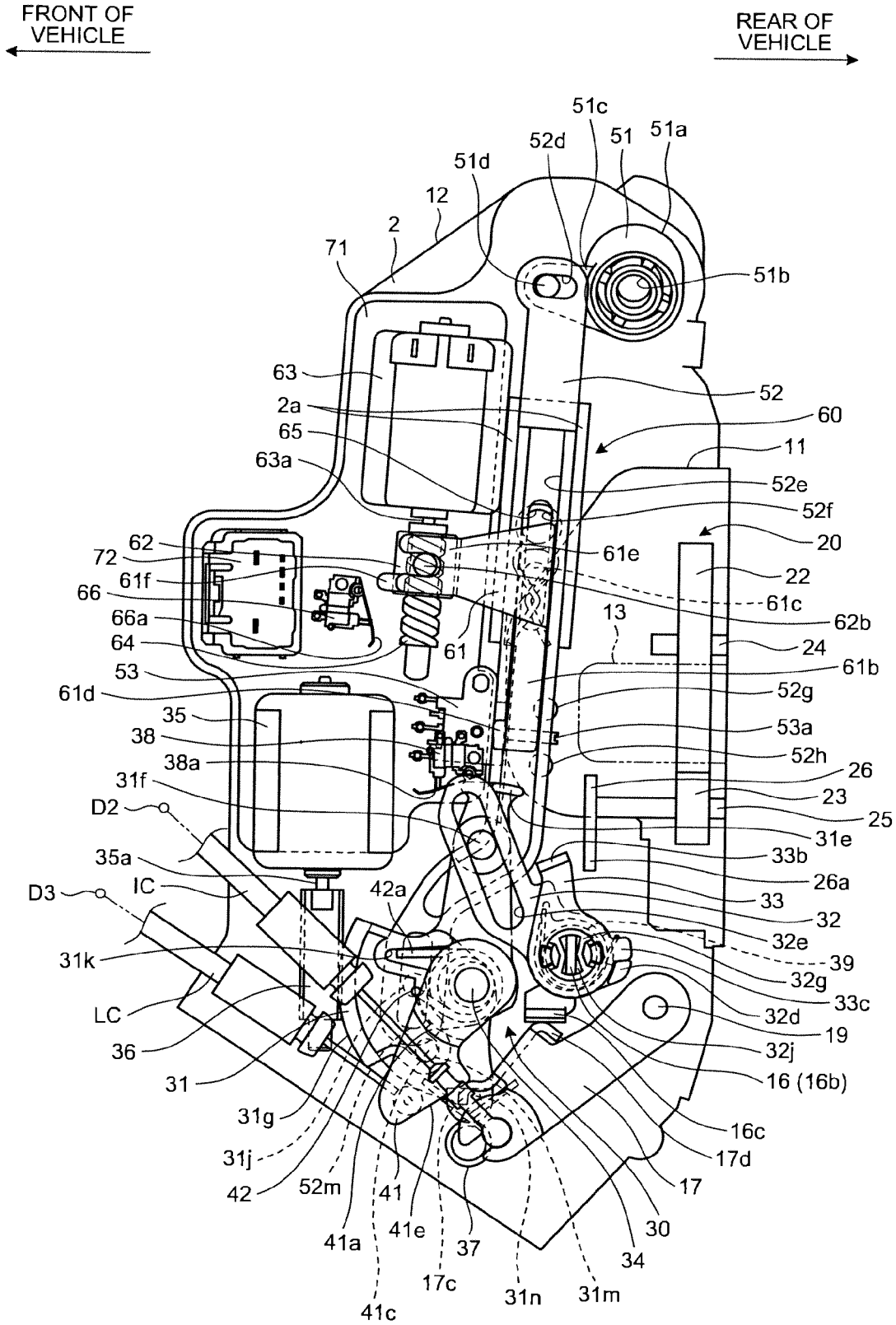
FIG. 19 is a schematic of a state when an inside door handle is open-operated in the state shown in FIG. 3.

When the open connecting portion 17*d* of the inside handle lever 17 moves upward, as shown in FIG. 19, the first link lever 32 and the second link lever 33 also move upwards via the pressure-receiving portion 16*c* of the open lever 16. When the lock lever 41 swings about the center of the sector lever shaft 34 in a clockwise direction, the connecting spring 42 is suitably and elastically deformed via the spring connecting portion 41*a*, thereby increasing the biasing force of the connecting spring 42. Accordingly, the spring acting portion 42*a* further presses the accommodating wall 31*h* that forms the upper portion of the spring operating groove 31*k* of the sector lever 31 (see FIG. 3), about the sector lever shaft 34 in a clockwise direction. When the spring acting portion 42*a* of the connecting spring 42 further presses the accommodating wall 31*h* that forms the upper portion of the spring operating groove 31*k* of the sector lever 31, and when the force exceeds the holding force of which the over-center spring 37 holds the sector lever 31 to the locked position, as shown in FIG. 19, the sector lever 31 connects with the lock lever 41, and integrally swings with the lock lever 41 about the sector lever shaft 34 in a clockwise direction. When the sector lever 31 swings, the connecting pin 31*f* moves to the rear of the vehicle, thereby swinging the first link lever 32 also in a clockwise direction in FIG. 3.

Figure 20:
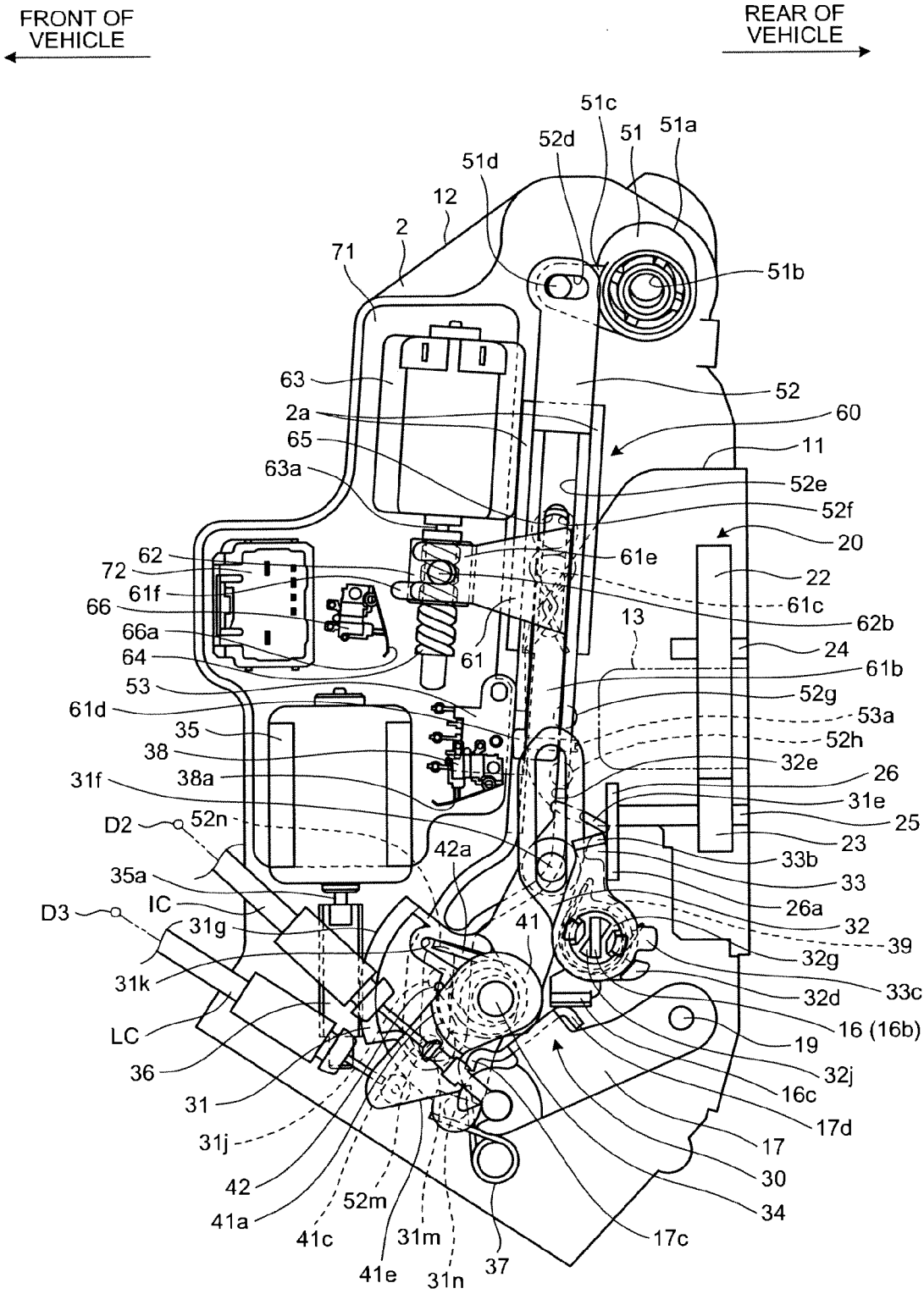
FIG. 20 is a schematic of a state when the inside door handle is continuously open-operated in the state shown in FIG. 19.

From the state shown in FIG. 19, when the open connecting portion 17*d* of the inside handle lever 17 further moves upwards, as shown in FIG. 20, the first link lever 32 and the second link lever 33 also move upwards via the pressure-receiving portion 16*c* of the open lever 16. From the state shown in FIG. 19, when the lock lever 41 swings about the center of the sector lever shaft 34 in a clockwise direction, the sector lever 31 connected via the connecting spring 42 further swings about the sector lever shaft 34 integrally with the lock lever 41 in a clockwise direction, while suitably rotating the worm 36, thereby disposing in the unlocked position. When the sector lever 31 swings more, the connecting pin 31*f* moves to the rear of the vehicle, thereby further swinging the first link lever 32 in a clockwise direction in FIG. 19. At this time, as shown in FIG. 20, the ratchet driving portion 33*b* of the second link lever 33 abuts to the abutting portion 26*a* of the ratchet lever 26 from the front side of the vehicle. Accordingly, the first link lever 32 cancels the abutting state with the locking portion 33*c* against the elastic restoring force of the panic spring 39, thereby swinging in a clockwise direction in FIG. 19.

When the open-operating force of the inside door handle D2 is removed from the state shown in FIG. 20, the open lever 16 moves the open operating end 16*b* and the pressure-receiving portion 16*c* downwards, by the elastic restoring force of the open lever spring (not shown). Accordingly, the first link lever 32 and the second link lever 33 also move downwards. When the open operating end 16*b* and the pressure-receiving portion 16*c* move downwards, as shown in FIG. 18, the lower facet of the pressure-receiving portion 16*c* is disposed so as to closely oppose to the open connecting portion 17*d* of the inside handle lever 17 again. When the first link lever 32 and the second link lever 33 move downward, as shown in FIG. 18, the abutting state between the ratchet driving portion 33*b* of the second link lever 33 and the abutting portion 26*a* of the ratchet lever 26 is cancelled. Subsequently, the locking portion 33*c* is moved so as to abut to the lever abutting portion 32*d* of the first link lever 32 again, by the elastic restoring force of the panic spring 39. When the second link lever 33 moves, as shown in FIG. 18, the ratchet driving portion 33*b* of the second link lever 33 is disposed vertically above the connecting tool 32*g* mounted on the first link lever 32 (cancel position). Accordingly, the ratchet driving portion 33*b* is closely opposed to the lower facet of the abutting portion 26*a* in the ratchet lever 26, thereby turning the lock mechanism 30 in the unlocked state.

In the state shown in FIG. 18, when the inside door handle D2 is open-operated, the open connecting portion 17*d* of the inside handle lever 17 moves upwards, thereby moving the first link lever 32 and the second link lever 33 also upwards via the pressure-receiving portion 16*c* of the open lever 16. At this time, the inside abutting surface 41*e* provided at the lock acting end 41*b* of the lock lever 41 is disposed at a position separated from the lock connecting portion 17*c* in the inside handle lever 17, thereby not abutting to the lock connecting portion 17*c*. Therefore, the second link lever 33 abuts to the abutting portion 26*a* of the ratchet lever 26 in the latch mechanism 20, thereby canceling the latched state. In other words, the door D can be opened and moved, by the open-operation of the inside door handle D2 (so-called double action mechanism).

As shown in FIG. 20, the state that the ratchet driving portion 33*b* of the second link lever 33 abuts to the abutting portion 26*a* of the ratchet lever 26 also occurs, for example, in the locked state shown in FIG. 3, when the outside door handle D1 is open-operated and the electric motor 35 is driven to switch the lock mechanism 30 to the unlocked state. In the locked state shown in FIG. 3, when the outside door handle D1 is open-operated, the ratchet driving portion 33*b* of the second link lever 33 moves the first link lever 32 and the second link lever 33 upwards by the rotation of the open lever 16, without moving the abutting portion 26*a* of the ratchet lever 26 in the latch mechanism 20 upwards. In this state, when the electric motor 35 is driven and the worm 36 is suitably rotated in any direction, the sector lever 31 swings about the sector lever shaft 34 in a clockwise direction. When the sector lever 31 swings, the connecting pin 31*f* moves to the rear of the vehicle, thereby also swinging the first link lever 32 in a clockwise direction in FIG. 3. At this time, the ratchet driving portion 33*b* of the second link lever 33 abuts to the abutting portion 26*a* of the ratchet lever 26 from the front side of the vehicle. Accordingly, the first link lever 32 cancels the abutting state with the locking portion 33*c* against the elastic restoring force of the panic spring 39, thereby turning in the state shown in FIG. 20.

In this state, when the open-operating force of the outside door handle D1 is removed, the open lever 16 moves the open operating end 16*b* and the pressure-receiving portion 16*c* downwards, by the elastic restoring force of the open lever spring (not shown). Accordingly, the first link lever 32 and the second link lever 33 also move downwards. When the first link lever 32 and the second link lever 33 move downwards, as shown in FIG. 18, the abutting state between the ratchet driving portion 33*b* of the second link lever 33 and the abutting portion 26*a* of the ratchet lever 26 is subsequently cancelled. Accordingly, the second link lever 33 moves the locking portion 33*c* so as to abut with the lever abutting portion 32*d* of the first link lever 32 again, by the elastic restoring force of the panic spring 39. When the second link lever 33 moves, as shown in FIG. 18, the ratchet driving portion 33*b* of the second link lever 33 is disposed vertically above the connecting tool 32*g* mounted on the first link lever 32 (cancel position). Subsequently, the ratchet driving portion 33*b* is closely opposed to the lower facet of the abutting portion 26*a* in the ratchet lever 26, thereby turning the lock mechanism 30 in the unlocked state.

When the outside door handle D1 is open-operated again from the state shown in FIG. 18, and the link main body 32*a* of the first link lever 32 moves upwards by the rotation of the open lever 16, the ratchet driving portion 33*b* of the second link lever 33 abuts to the abutting portion 26*a* of the ratchet lever 26 in the latch mechanism 20, thereby moving the latch mechanism 20 upwards. As a result, even if the latch mechanism 20 is in the latched state, the latched state is cancelled, thereby enabling to open and move the door D with respect to the vehicle main body.

The door lock apparatus, as shown in FIG. 3, also includes a key lever 51 and a key link 52 in the lock mechanism accommodating portion 12. The key lever 51 is operated when a key cylinder KC arranged at the door D is key-operated. The key link 52 is operated when the key lever 51 is operated, and switches the lock mechanism 30 in the locked state to the unlocked state or switches the lock mechanism 30 in the unlocked state to the locked state.

Figure 16:
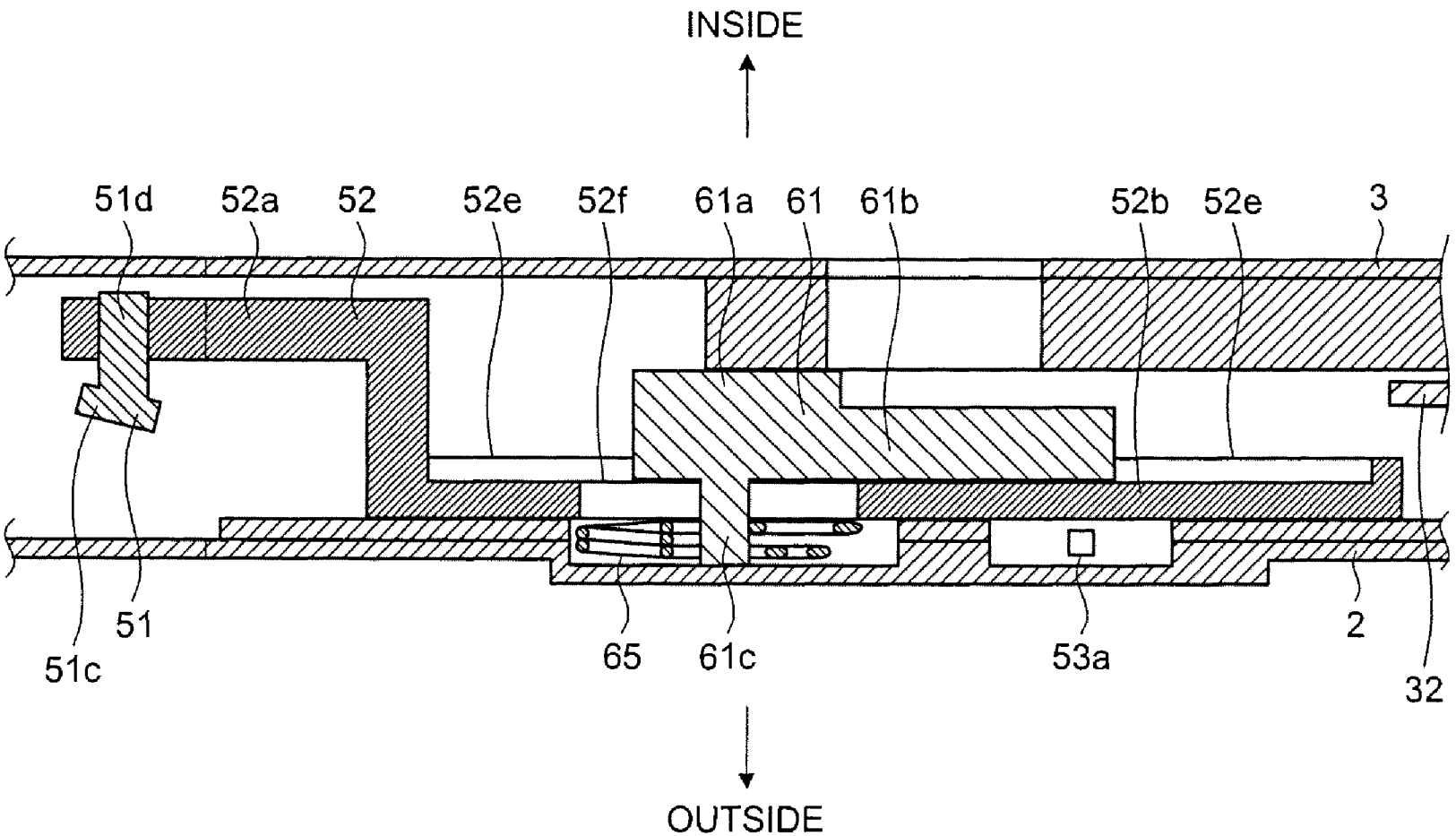
FIG. 16 is a sectional view taken along a line D-D in FIG. 3.

The key lever 51, as shown in FIG. 3, is arranged in a region further above the latch 22 of the latch mechanism 20. The key lever 51 includes an input shaft portion 51*a* as an input portion in which the rotating driving force is entered, when the key cylinder KC arranged at the door D is key-operated. The key lever 51 is rotatably supported about the center along the left-right direction of the vehicle main body, by fitting a convex (not shown) provided at the sub case 3 in a rotation concave portion 51*b* recessed so as to open toward the inside of the vehicle in the input shaft portion 51*a*. A cylinder connecting unit CC such as a link and a cable that transmits the rotating driving force, which is generated when the key cylinder KC is key-operated, is connected to the input shaft portion 51*a* (see FIG. 1). More specifically, the cylinder connecting unit CC is connected so that when the key cylinder KC is unfastened, the key lever 51 rotates about the center of the rotation concave portion 51*b* in a clockwise direction in FIG. 3, and when the key cylinder KC is fastened, the key lever 51 rotates about the center of the rotation concave portion 51*b* in an anti-clockwise direction in FIG. 18. The key lever 51, as shown in FIGS. 3 and 16, includes a lever portion 51*c* and a lever pin 51*d*. The lever portion 51*c* is a portion that extends towards the front of the vehicle from the input shaft portion 51*a*. The lever pin 51*d* is a columnar protrusion that extends substantially horizontally along the left-right direction of the vehicle main body, from the facet positioned at the inside of the vehicle in the lever portion 51*c*.

Figure 10A:
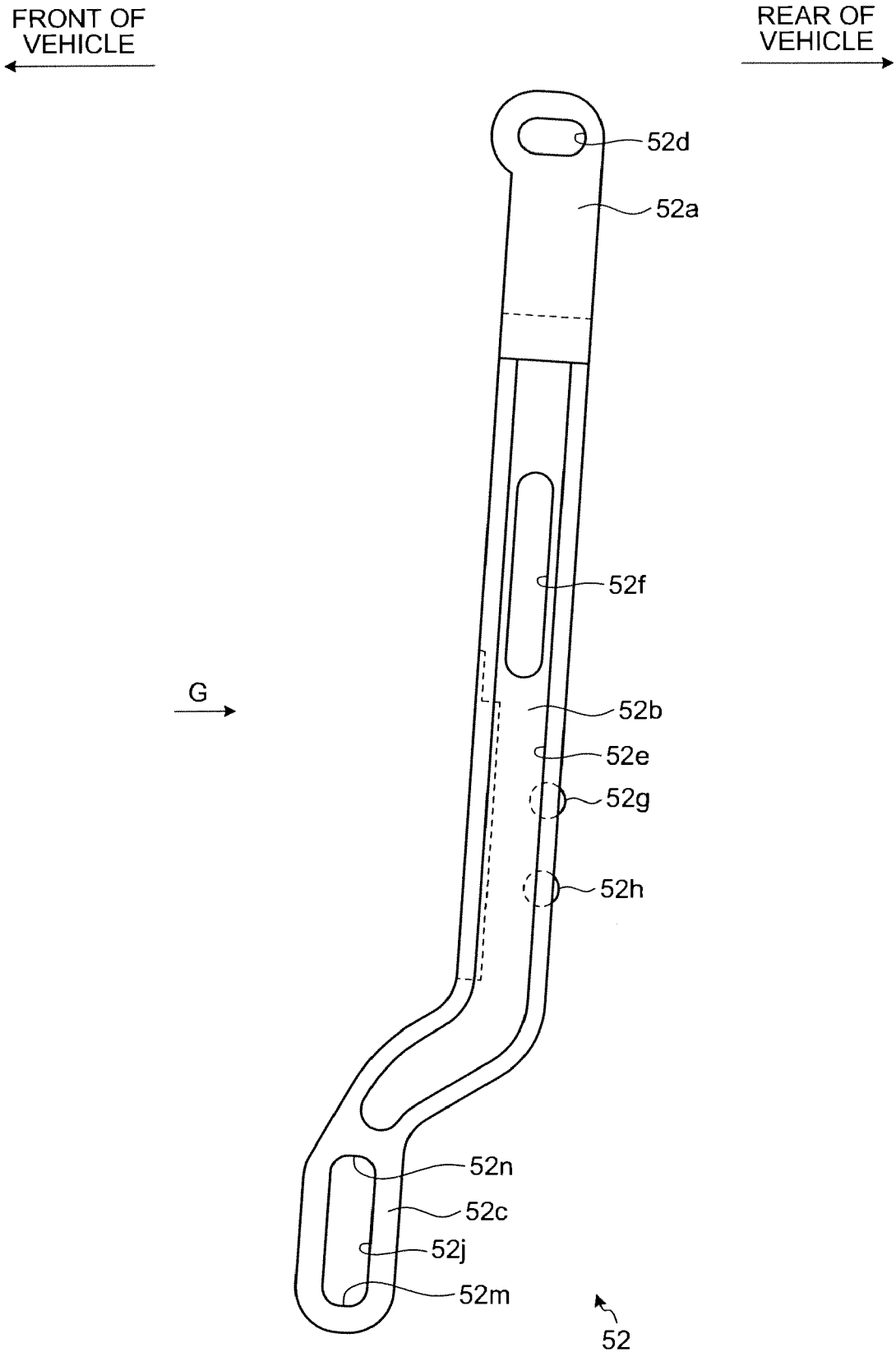
FIG. 10A is a front view of a key link applied to the door lock apparatus shown in FIG. 1.
Figure 10B:
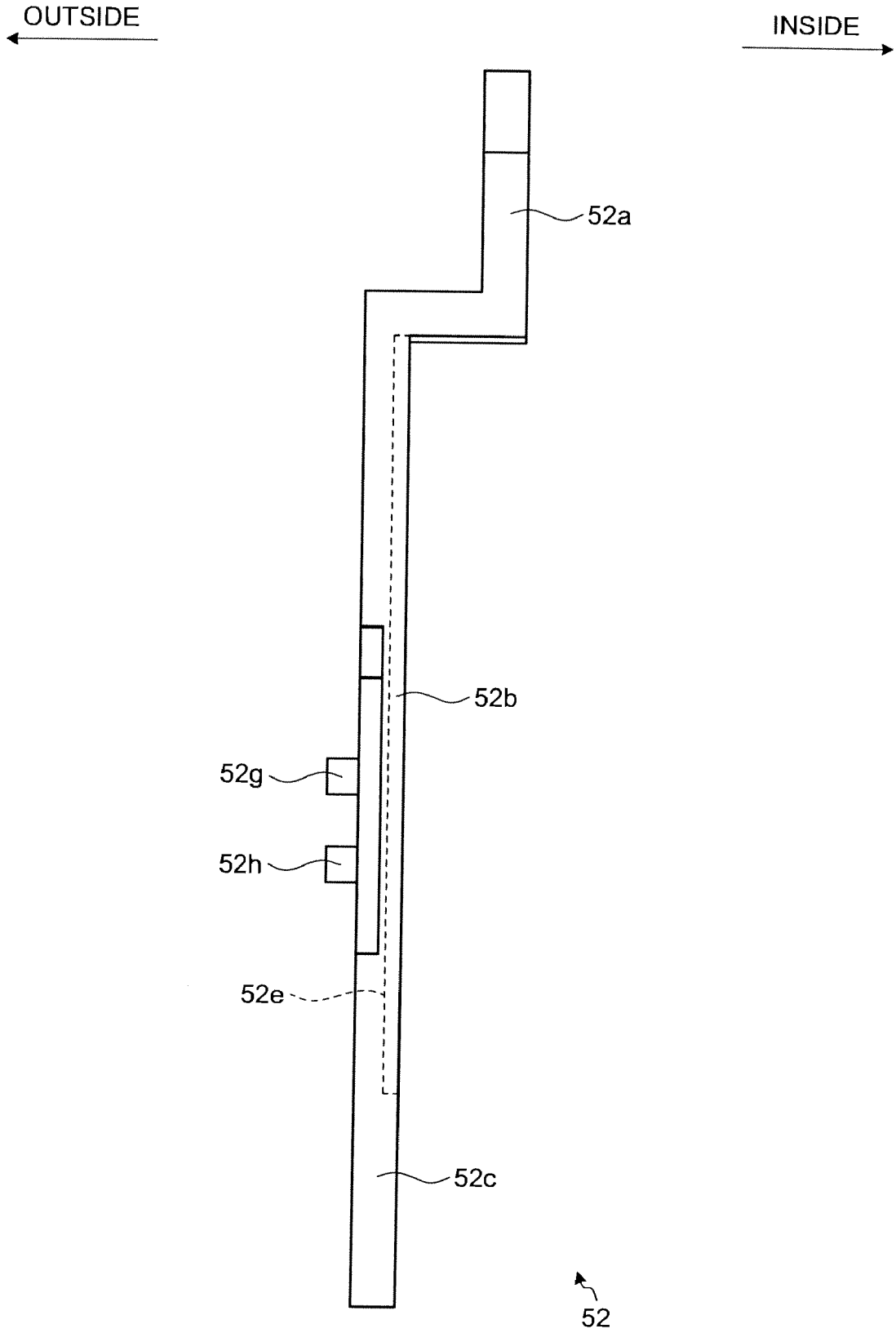
FIG. 10B is a fragmentary view of the key link shown in FIG. 10A taken in the direction of the arrow G.

The key link 52, as shown in FIG. 3, is slidably arranged along the longitudinal direction of a pair of guide bodies 2*a* provided in the main case 2, and formed in the longitudinal shape across the upper end to the lower end of the housing 10. The key link 52, as shown in FIGS. 10A and 10B, includes a key connecting end 52*a*, a double lock connecting portion 52*b*, and a sector connecting end 52*c*.

The key connecting end 52*a* is a portion positioned above the pair of guide bodies 2*a* provided in the main case 2 in the key link 52, and includes a key connecting groove hole 52*d*. The key connecting groove hole 52*d* is a slit opening formed along the front-rear direction of the vehicle main body, at the upper region in the key connecting end 52*a*. As apparent from FIG. 3, the key connecting groove hole 52*d* movably fits and supports the lever pin 51*d* of the key lever 51 therein.

The double lock connecting portion 52*b* is a longitudinal portion that bends and extends downward, after bending towards the outside of the vehicle from the end positioned at the lower portion in the key connecting end 52*a*. The double lock connecting portion 52*b* includes a lever supporting groove 52*e*, a key operating groove hole 52*f*, a lock recognizing protrusion 52*g*, and an unlock recognizing protrusion 52*h*. The lever supporting groove 52*e* is a groove recessed along the longitudinal direction of the double lock connecting portion 52*b*, so as to open toward the inside of the vehicle. The key operating groove hole 52*f* is a slit opening formed at the upper region in the double lock connecting portion 52*b*, along the extending direction of the lever supporting groove 52*e*. The lock recognizing protrusion 52*g* and the unlock recognizing protrusion 52*h* are columnar protrusions that respectively and substantially horizontally extend along the left-right direction of the vehicle main body, from the facet positioned at the region outside the vehicle below the lever supporting groove 52*e* in the double lock connecting portion 52*b*. As apparent from FIG. 3, the lock recognizing protrusion 52*g* and the unlock recognizing protrusion 52*h* are placed side by side along the extending direction of the double lock connecting portion 52*b*.

Figure 14:
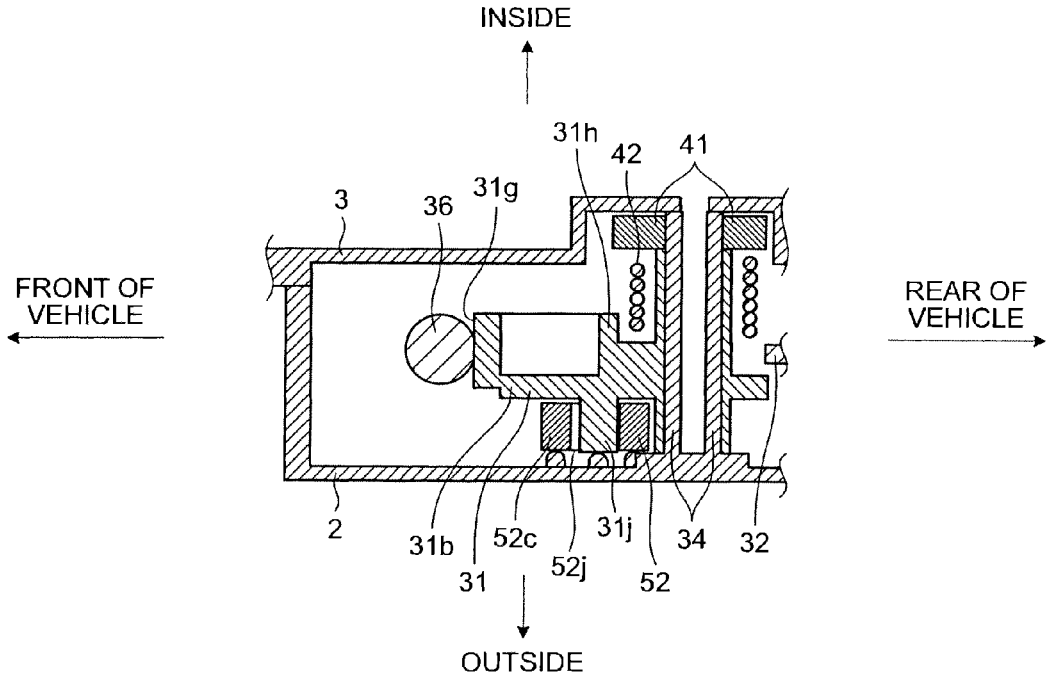
FIG. 14 is a sectional view taken along a line B-B in FIG. 3.

The sector connecting end 52*c* is a portion that extends downward after inclined and extended gradually towards the front of the vehicle, as moving downwards from the end positioned at the lower portion of the double lock connecting portion 52*b*. The sector connecting end 52*c* includes a sector connecting hole 52*j*. The sector connecting hole 52*j* is a slit opening formed along the extending direction of the sector connecting end 52*c*, and as shown in FIG. 14, movably inserts the key operating pin 31*j* of the sector lever 31 therein. In the sector connecting hole 52*j*, when the lock mechanism 30 is in the locked state, as shown in FIG. 3, the inner wall surface of an unlock portion 52*m* positioned at the lower portion is disposed at a position adjacent to the key operating pin 31*j* of the sector lever 31. When the lock mechanism 30 is in the unlocked state, as shown in FIG. 18, the inner wall surface of a lock portion 52*n* positioned at the upper portion is disposed at a position adjacent to the key operating pin 31*j* of the sector lever 31.

As shown in FIG. 3, a key switch 53 is arranged at the front region of the vehicle of the double lock connecting portion 52*b* in the key link 52. The key switch 53 interposes a detection piece 53*a* between the lock recognizing protrusion 52*g* and the unlock recognizing protrusion 52*h* of the key link 52, and detects the position of the key link 52, depending on the contact state of the lock recognizing protrusion 52*g* and the unlock recognizing protrusion 52*h* with respect to the detection piece 53*a*.

It is not always necessary to drive the electric motor 35 or lock the lock knob D3, to shift the lock mechanism 30 in the unlocked state shown in FIG. 18 to the locked state shown in FIG. 3, but it is also possible by fastening the key cylinder KC. In other words, from the unlocked state shown in FIG. 18, when the key lever 51 is rotated about the center of the rotation concave portion 51*b* in an anti-clockwise direction by the key-operation of the key cylinder KC, the key link 52 engaged via the lever pin 51*d* slidably moves downwards along the longitudinal direction of the pair of guide bodies 2*a* provided in the main case 2. When the key link 52 slidably moves downwards along the longitudinal direction of the pair of guide bodies 2*a* provided in the main case 2, the inner wall surface of the lock portion 52*n* moves the key operating pin 31*j* of the sector lever 31 downwards in the sector connecting hole 52*j*. At this time, the lock recognizing protrusion 52*g* presses the detection piece 53*a* of the key switch 53 downwards. Accordingly, the key switch 53 detects the key operation, in other words, a fastening operation of the key cylinder KC from the movement of the key link 52. When the key operating pin 31*j* of the sector lever 31 moves downwards, the sector lever 31 swings about the sector lever shaft 34 in an anti-clockwise direction, while suitably rotating the worm 36. As a result, the first link lever 32 engaged via the connecting pin 31*f* and the second link lever 33 that abuts to the lever abutting portion 32*d* swing about the fitting hole 32*j* in an anti-clockwise direction. Accordingly, the lock mechanism 30 is turned in the locked state shown in FIG. 3.

It is also not always necessary to drive the electric motor 35 to shift the lock mechanism 30 in the locked state shown in FIG. 3 to the unlocked state shown in FIG. 18, but it is also possible by unfastening the key cylinder KC. In other words, from the locked state shown in FIG. 3, when the key lever 51 is rotated about the center of the rotation concave portion 51*b* in a clockwise direction, by the key operation of the key cylinder KC, the key link 52 engaged via the lever pin 51*d* slidably moves upwards along the longitudinal direction of the pair of guide bodies 2*a* provided in the main case 2. When the key link 52 slidably moves upwards along the longitudinal direction of the pair of guide bodies 2*a* provided in the main case 2, the inner wall surface of the unlock portion 52*m* moves the key operating pin 31*j* of the sector lever 31 upwards in the sector connecting hole 52*j*. At this time, the unlock recognizing protrusion 52*h* presses the detection piece 53*a* of the key switch 53 upward. Accordingly, the key switch 53 detects the key operation, in other words, an unfastening operation of the key cylinder KC from the movement of the key link 52. When the key operating pin 31*j* of the sector lever 31 moves upwards, the sector lever 31 swings about the sector lever shaft 34 in a clockwise direction, while suitably rotating the worm 36. As a result, the first link lever 32 engaged via the connecting pin 31*f* and the second link lever 33 biased by the panic spring 39 swing about the fitting hole 32*j* in a clockwise direction. Accordingly, the lock mechanism 30 is turned in the unlocked state shown in FIG. 18.

The door lock apparatus, as shown in FIG. 3, also includes a double lock mechanism 60 in the lock mechanism accommodating portion 12. The double lock mechanism 60 is switchably formed between an unset state and a set state, and includes a double lock lever 61.

Figure 21:
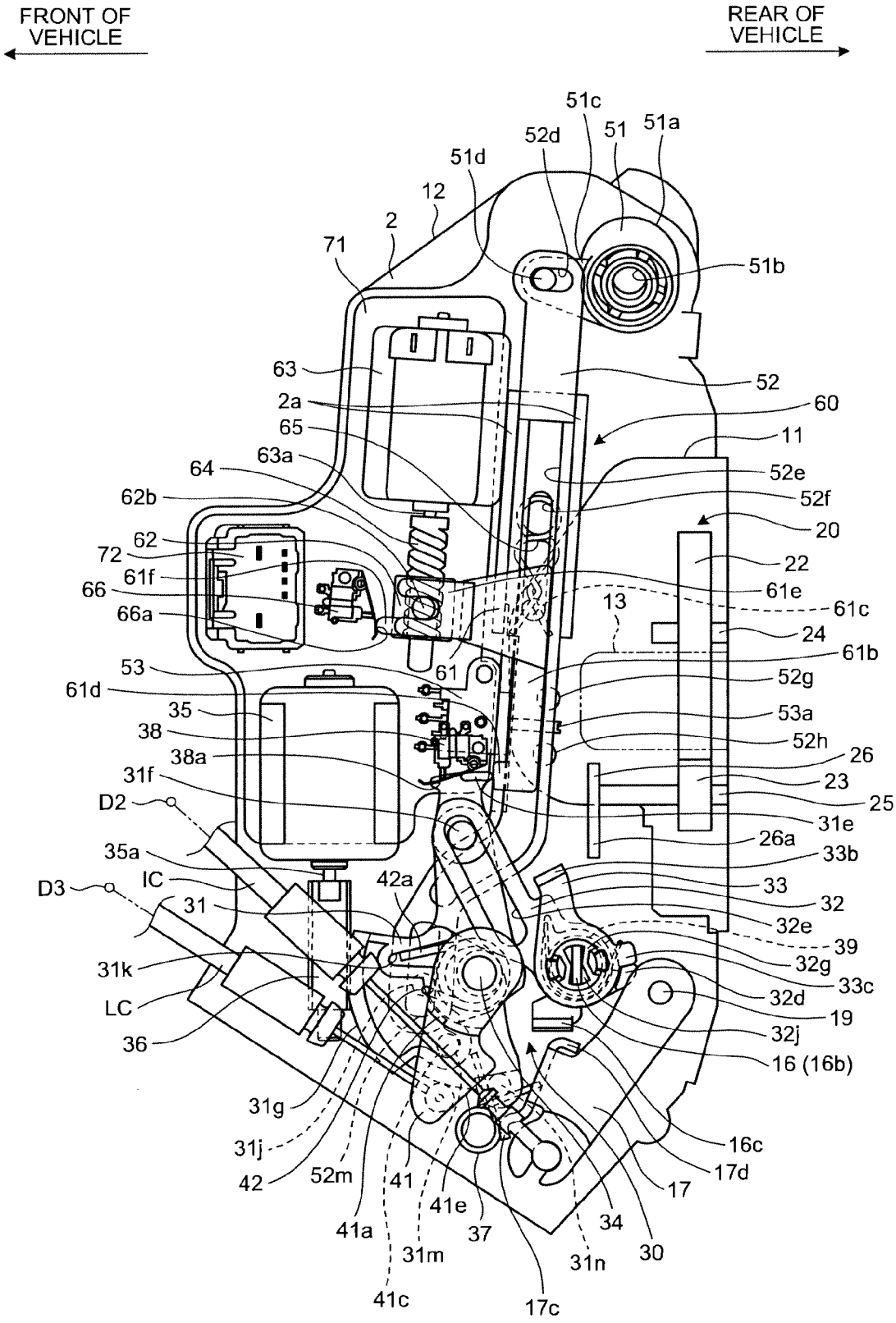
FIG. 21 is a schematic of the door lock apparatus shown in FIG. 1 when a double lock mechanism is in a set state.

The double lock lever 61, as shown in FIG. 3, is linearly and movably formed between an unset position and a set position. The unset position is where the double lock lever 61 is slidably moved upward to the maximum extent as shown in FIG. 3, and the set position is where the double lock lever 61 is slidably moved downward to the maximum extent as shown in FIG. 21. The double lock lever 61, as shown in FIGS. 11A and 11B, includes a sliding portion 61*b*, an unset operating pin 61*c*, and a block portion 61*d* at the rear region of the vehicle in a base 61*a*.

The sliding portion 61*b* is a portion that longitudinally extends downward from the facet positioned at the outside of the vehicle in the base 61*a*. The sliding portion 61*b* is movably fitted to the lever supporting groove 52*e* of the key link 52 (see FIG. 17). The unset operating pin 61*c* is a columnar protrusion that extends substantially horizontally along the left-right direction of the vehicle main body, from the facet positioned at the outside of the vehicle, at the region above the sliding portion 61*b*. The unset operating pin 61*c* is movably inserted into the key operating groove hole 52*f* of the key link 52. When the double lock lever 61 is disposed at the set position shown in FIG. 21, the unset operating pin 61*c* is disposed at the lower end of the key operating groove hole 52*f*. When the double lock lever 61 is disposed at the unset position shown in FIG. 3, the unset operating pin 61*c* is disposed at substantially the center in the vertical direction in the key operating groove hole 52*f*. The block portion 61*d* is a portion projected towards the front side of the vehicle, from the extended end positioned below the sliding portion 61*b*. When the double lock lever 61 is disposed at the set position shown in FIG. 21, the block portion 61*d* comes adjacent to the block protrusion 31*e* of the sector lever 31, and disposed in the swinging range when the block protrusion 31*e* swings about the sector lever shaft 34. When the double lock lever 61 is disposed at the unset position shown in FIG. 3, the block portion 61*d* is disposed outside the swinging range of the block protrusion 31*e*.

Figure 11A:
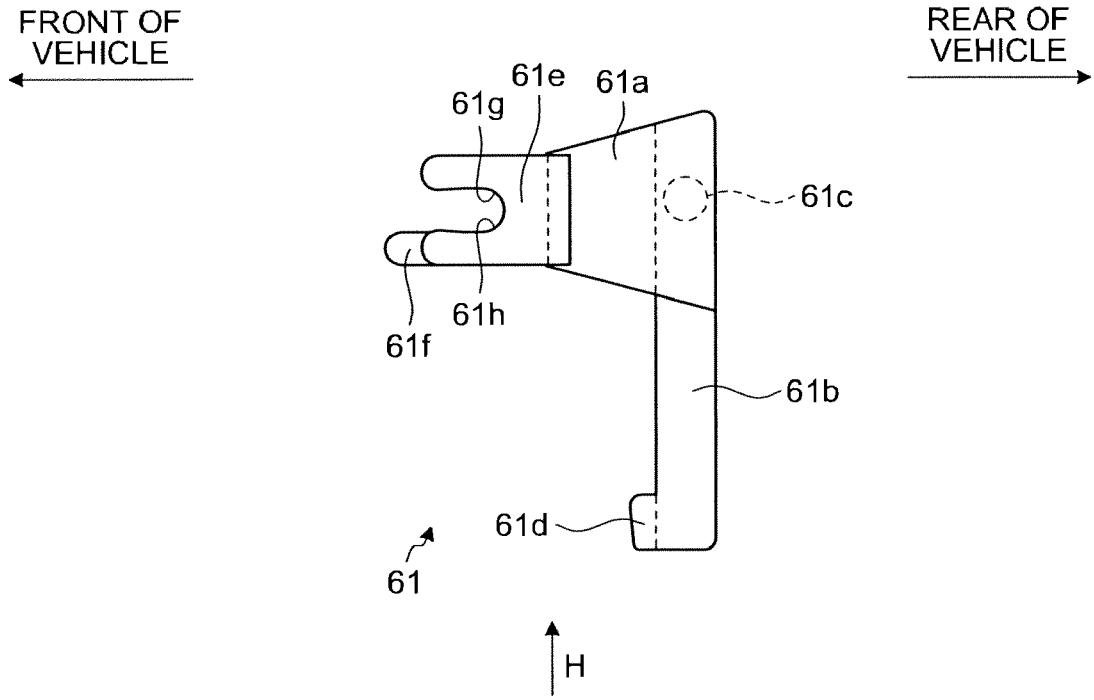
FIG. 11A is a front view of a double lock lever applied to the door lock apparatus shown in FIG. 1.
Figure 11B:
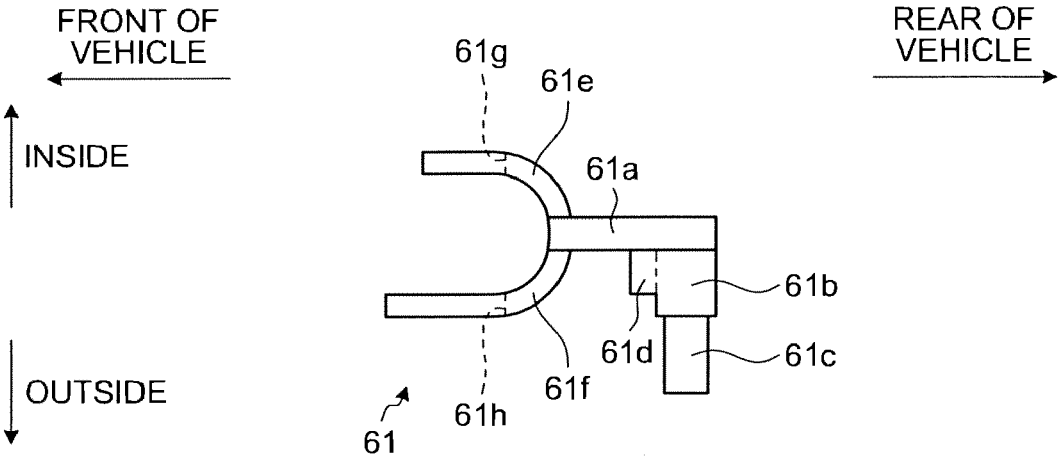
FIG. 11B is a fragmentary view of the double lock lever shown in FIG. 11A taken in the direction of the arrow H.

The double lock lever 61, as shown in FIGS. 11A and 11B, includes a first arm portion 61*e* and a second arm portion 61*f*, at the front region of the vehicle in the base 61*a*. The first arm portion 61*e* is a portion that extends towards the front of the vehicle, after being curved and extended towards the front of the vehicle, from the facet positioned at the inside of the vehicle in the base 61*a*. The first arm portion 61*e* includes a gripping groove 61*g* curved so as to open toward the front of the vehicle. The second arm portion 61*f* is a portion that extends towards the front of the vehicle, after being curved and extended towards the front of the vehicle, from the facet positioned at the outside of the vehicle in the base 61*a*. The second arm portion 61*f* includes a gripping groove 61*h* curved so as to open toward the front of the vehicle.

Figure 12A:
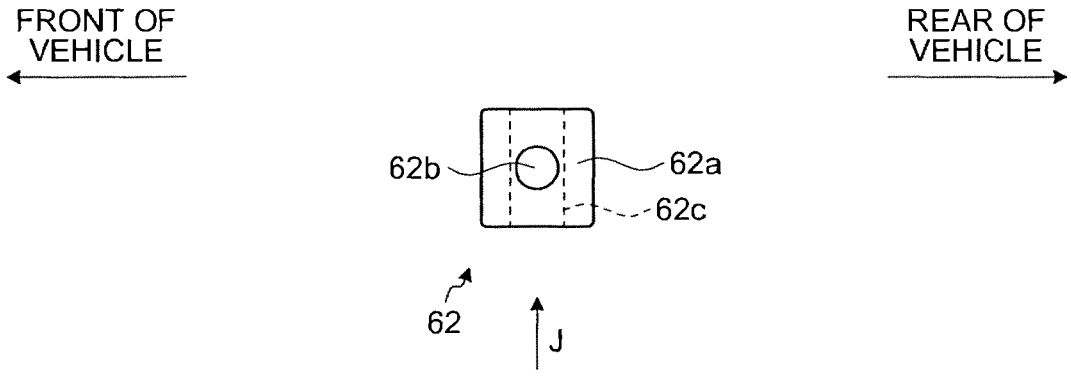
FIG. 12A is a front view of a link pin applied to the door lock apparatus shown in FIG. 1.
Figure 12B:
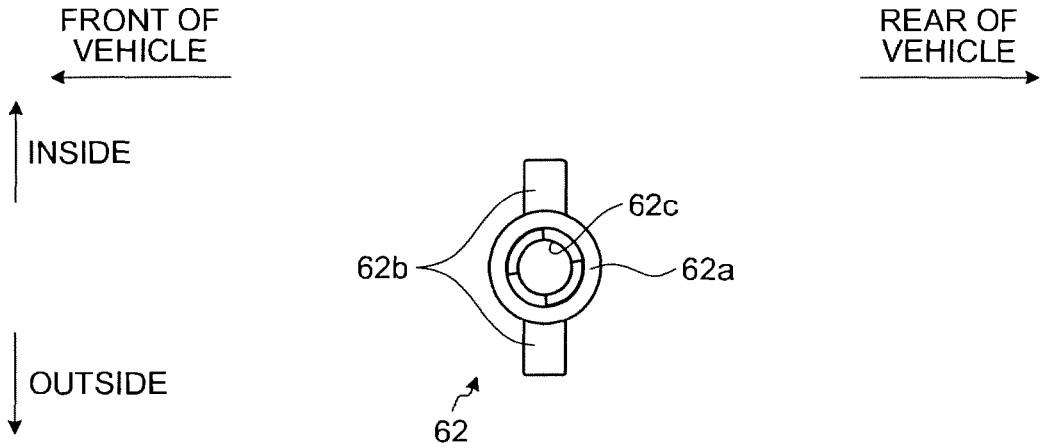
FIG. 12B is a fragmentary view of the link pin shown in FIG. 12A taken in the direction of the arrow J.
Figure 17:
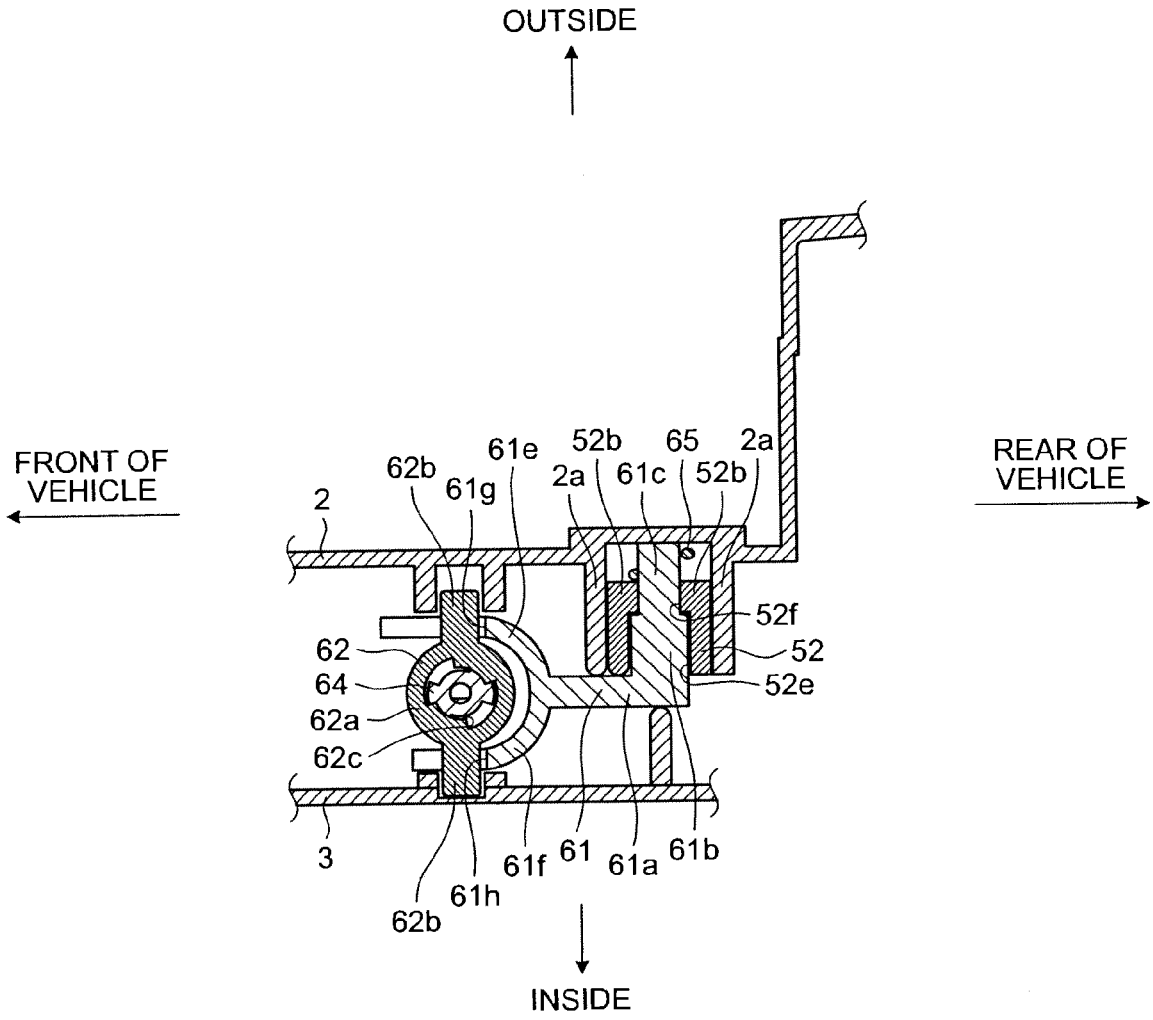
FIG. 17 is a sectional view taken along a line E-E in FIG. 3.

As shown in FIGS. 3 and 17, a link pin 62 is provided between the first arm portion 61*e* and the second arm portion 61*f* in the double lock lever 61. The link pin 62 is interlocked with the double lock lever 61, and as shown in FIGS. 12A and 12B, includes a pin main body 62*a* and a pair of transmission pins 62*b* that interlocks the pin main body 62*a* and the double lock lever 61. The pin main body 62*a* is a cylinder that includes a gear portion 62*c* therein. The gear portion 62*c* is a gear formed at an inner peripheral surface of the pin main body 62*a* and meshed with a worm 64 fixed to an output shaft 63*a* of an electric motor 63 (see FIG. 17). The pair of transmission pins 62*b* is a columnar protrusion that respectively extends substantially horizontally along the left-right direction of the vehicle main body, from the outer peripheral surface positioned at the inside and the outside of the vehicle in the pin main body 62*a*. The pair of transmission pins 62*b* is respectively disposed at the gripping groove 61*g* of the first arm portion 61*e* and at the gripping groove 61*h* of the second arm portion 61*f* in the double lock lever 61.

As shown in FIGS. 3 and 17, an over-center spring 65 is provided between the key link 52 and the main case 2. The over-center spring 65 holds the double lock lever 61 via the unset operating pin 61*c*. More specifically, as shown in FIG. 3, the over-center spring 65 holds the double lock lever 61 either at the unset position where the double lock lever 61 is slidably moved upward to the maximum extent along the longitudinal direction of the sliding portion 61*b*, as shown in FIG. 3, or at the set position where the double lock lever 61 is slidably moved downward to the maximum extent along the longitudinal direction of the sliding portion 61*b*, as shown in FIG. 21.

As shown in FIG. 21, a double lock switch 66 is arranged at the front side of the vehicle of the double lock lever 61. The double lock switch 66 detects whether the double lock lever 61 is at the set position, corresponding to the contact state of the extended end of the second arm portion 61*f* in the double lock lever 61 with respect to a detection piece 66*a*.

The electric motor 35, the lock switch 38, the key switch 53, the electric motor 63, and the double lock switch 66, as shown in FIG. 3, are connected to a circuit substrate 71 arranged inside the lock mechanism accommodating portion 12. In the circuit substrate 71, a connector 72 that supplies power to each motor and each switch is arranged. The connector 72 forms a power supplying system, and also used as a communication tool to input electric signal to each motor from a controlling portion (not shown) of the vehicle main body, or to output electric signal to the controlling portion (not shown) of the vehicle main body from each switch. As apparent from FIG. 2, the connector 72 is exposed to outside through an opening 3*b* provided at the sub case 3. The opening 3*b* provided at the sub case 3, when the door lock apparatus is arranged in the door D, is exposed to the outside of the door D through an opening (not shown) provided at the inside panel IP positioned at the inside of the vehicle of the door D (see FIG. 1).

The opening 3*b* provided at the sub case 3 includes a guiding portion 3*c* that extends towards the inside panel IP from the periphery. In the circumference direction of the guiding portion 3*c*, a seal member 73 in a circular shape is provided so as to surround the guiding portion 3*c*. The seal member 73, as shown in FIG. 1, when the door lock apparatus is fixed to the door D via a plurality of screw holes 14*b* while the opening 3*b* and the guiding portion 3*c* are faced to the opening (not shown) provided at the inside panel IP, is suitably deformed by being pressed by the inside panel IP. Accordingly, the desired sealing characteristics can be obtained in the housing 10.

With the double lock mechanism 60 formed as the above, the state shown in FIG. 3 is the unset state. In the unset state, the double lock lever 61 is disposed at the unset position. Accordingly, the block portion 61*d* is disposed outside the swinging range of the block protrusion 31*e* in the sector lever 31.

From the unset state shown in FIG. 3, when the electric motor 63 is driven and the worm 64 is suitably rotated in any direction, the link pin 62 moves downwards along the extending direction of the worm 64. When the link pin 62 moves downwards along the extending direction of the worm 64, the first arm portion 61*e* and the second arm portion 61*f* that form the lower portion of the gripping groove 61*g* and the gripping groove 61*h* of the double lock lever 61 respectively move downwards via the pair of transmission pins 62*b*. As a result, the double lock lever 61 moves linearly downwards along the longitudinal direction, while being guided by the lever supporting groove 52*e* of the key link 52 via the sliding portion 61*b*. Accordingly, the double lock mechanism 60 is turned in the set state shown in FIG. 21.

In the set state, the double lock lever 61 is disposed at the set position. Accordingly, the block portion 61*d* is disposed in the swinging range of the block protrusion 31*e* in the sector lever 31. When the inside door handle D2 is open-operated from this state, the first link lever 32 and the second link lever 33 move upwards, because the open connecting portion 17*d* in the inside handle lever 17 moves. At the same time, the lock connecting portion 17*c* abuts to the inside abutting surface 41*e* of the lock lever 41, thereby swinging the lock lever 41 about the center of the sector lever shaft 34 in a clockwise direction. When the open connecting portion 17*d* of the inside handle lever 17 moves upward, the first link lever 32 and the second link lever 33 also move upwards via the pressure-receiving portion 16*c* of the open lever 16. When the lock lever 41 swings about the center of the sector lever shaft 34 in a clockwise direction, the connecting spring 42 is suitably and elastically deformed via the spring connecting portion 41*a*. Accordingly, the biasing force of the connecting spring 42 is increased, and the spring acting portion 42*a* further presses the accommodating wall 31*h* that forms the upper portion of the spring operating groove 31*k* of the sector lever 31 (see FIG. 21), about the sector lever shaft 34 in a clockwise direction. However, even if the spring acting portion 42*a* of the connecting spring 42 further presses the accommodating wall 31*h* that forms the upper portion of the spring operating groove 31*k* of the sector lever 31, the block protrusion 31*e* of the sector lever 31 abuts to the block portion 61*d* of the double lock lever 61. Accordingly, the sector lever 31 is prevented from swinging towards the unlocked position. In other words, in the set state, even if the lock lever 41 swings about the center of the sector lever shaft 34 in a clockwise direction, only the connecting spring 42 suitably and elastically deforms, and the sector lever 31 in the locked position does not swing to the unlocked position. Subsequently, the lock lever 41 is individually operated from the sector lever 31. As a result, the lock mechanism 30 in the locked state is prevented from being switched to the unlocked state by the open-operation of the inside door handle D2. Accordingly, the door D cannot be opened or moved by the open-operation of the inside door handle D2.

In the set state shown in FIG. 21, for example, even if a malicious person illegally operates the lock connecting unit LC and swings the lock lever 41 about the center of the sector lever shaft 34 in a clockwise direction, only the connecting spring 42 suitably and elastically deforms, and the sector lever 31 in the locked position does not swing to the unlocked position. Accordingly, the lock lever 41 is individually operated from the sector lever 31. As a result, the lock mechanism 30 in the locked state is prevented from being switched to the unlocked state, also by the operation of the lock connecting unit LC. Subsequently, the door D is maintained in the closed position with respect to the vehicle main body.

From the set state shown in FIG. 21, when the electric motor 63 is driven and the worm 64 is suitably rotated in any direction, the link pin 62 moves upwards along the extending direction of the worm 64. When the link pin 62 moves upwards along the extending direction of the worm 64, the first arm portion 61*e* and the second arm portion 61*f* that form the upper portion of the gripping groove 61*g* and the gripping groove 61*h* of the double lock lever 61 also move upward via the pair of transmission pins 62*b*, respectively. As a result, the double lock lever 61 moves linearly upward along the longitudinal direction, while being guided by the lever supporting groove 52*e* of the key link 52 via the sliding portion 61*b*. Accordingly, the double lock mechanism 60 returns again to the unset state shown in FIG. 3.

Figure 22:
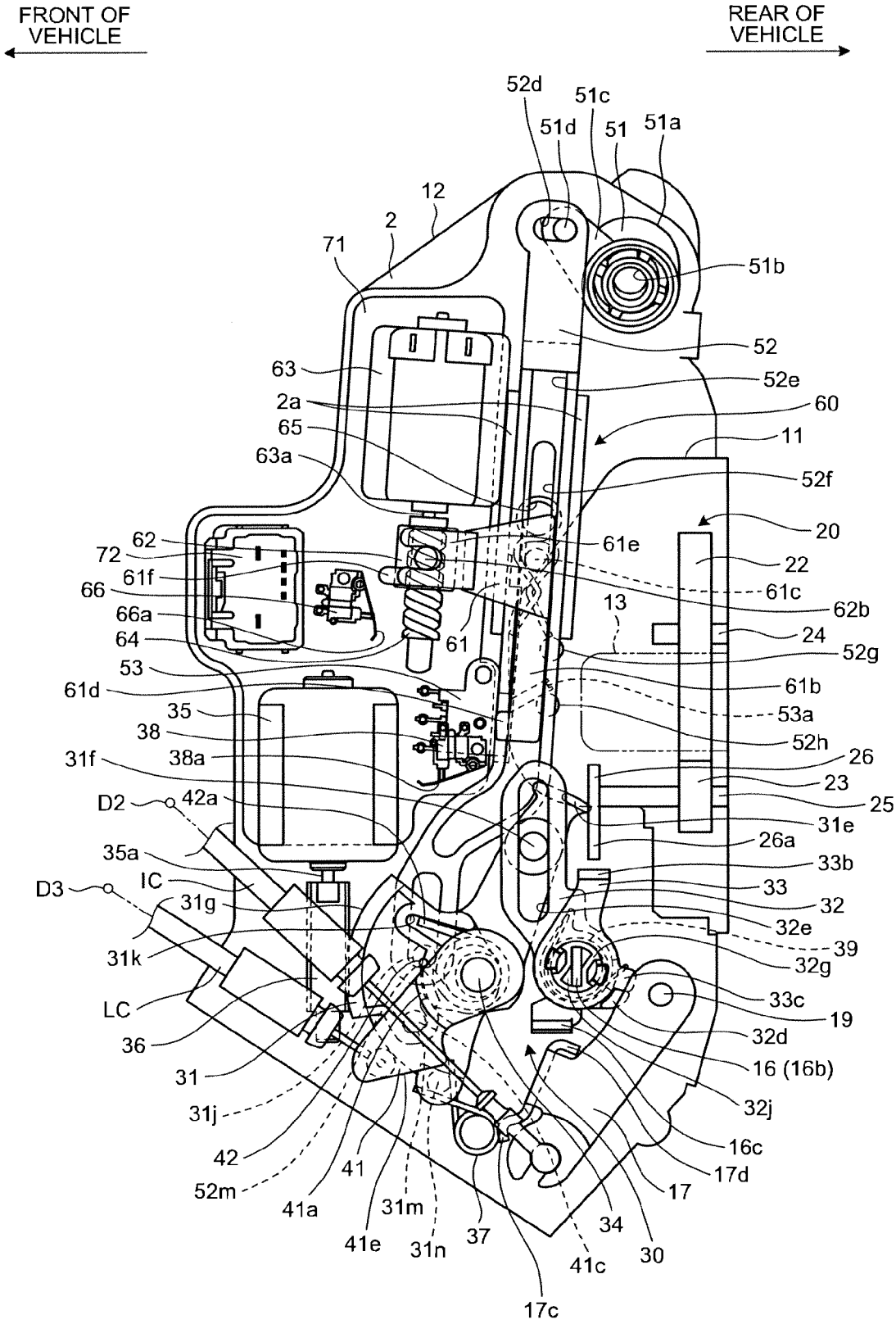
FIG. 22 is a schematic of a state when a key cylinder is unfastened in the state shown in FIG. 21.

It is not always necessary to drive the electric motor 63 to shift the double lock mechanism 60 in the set state shown in FIG. 21 to the unset state, but it is also possible by unfastening the key cylinder KC. In other words, from the set state shown in FIG. 21, when the key lever 51 is rotated about the center of the rotation concave portion 51*b* in a clockwise direction by the key operation of the key cylinder KC, the key link 52 engaged via the lever pin 51*d* slidably moves upwards along the longitudinal direction of the pair of guide bodies 2*a* provided in the main case 2. When the key link 52 slidably moves upwards along the longitudinal direction of the pair of guide bodies 2*a* provided in the main case 2, the inner wall surface at the lower end in the key operating groove hole 52*f* moves the unset operating pin 61*c* of the double lock lever 61 upwards. Subsequent to the movement of the double lock lever 61, the inner wall surface of the unlock portion 52*m* also moves the key operating pin 31*j* of the sector lever 31 upwards in the sector connecting hole 52*j*. When the unset operating pin 61*c* of the double lock lever 61 moves upwards, as shown in FIG. 22, the double lock lever 61 suitably rotates the worm 64 via the link pin 62. The double lock lever 61 also moves linearly upwards along the longitudinal direction, while being guided by the lever supporting groove 52*e* of the key link 52 via the sliding portion 61*b*. After the block portion 61*d* of the double lock lever 61 moves outside the swinging range of the block protrusion 31*e* in the sector lever 31, as shown in FIG. 22, the key operating pin 31*j* of the sector lever 31 moves upwards, thereby swinging the sector lever 31 about the sector lever shaft 34 in a clockwise direction while suitably rotating the worm 36. At this time, because the unlock recognizing protrusion 52*h* presses the detection piece 53*a* of the key switch 53 upwards, the key switch 53 detects the key operation, in other words, an unfastening operation of the key cylinder KC from the movement of the key link 52. As a result, the double lock lever 61 is disposed at the unset position, thereby turning the double lock mechanism 60 in the unset state. The first link lever 32 engaged via the connecting pin 31*f* and the second link lever 33 biased by the panic spring 39 swing about the fitting hole 32*j* in a clockwise direction, thereby turning the lock mechanism 30 in the unlocked state shown in FIG. 18.

The door lock apparatus according to the first embodiment formed as the above, at both sides of the region interposing the second link lever 33 therebetween, includes the sector lever shaft 34 and the inside lever shaft 19 that extend in parallel with the swinging shaft of the second link lever 33. The door lock apparatus according to the first embodiment also includes the inside handle lever 17 swingably arranged between the unlocked position and the locked position about the sector lever shaft 34, and also swingably arranged about the inside lever shaft 19. The inside handle lever 17, when the inside door handle D2 arranged inside the vehicle is open-operated while the second link lever 33 is disposed in the cancel position, moves the second link lever 33 upwards by swinging about the center of the inside lever shaft 19. The inside handle lever 17, when the inside door handle D2 is open-operated while the second link lever 33 is disposed in the non-cancel position, swings the sector lever 31 in the locked position to the unlocked position about the center of the sector lever shaft 34, by swinging about the center of the inside lever shaft 19. Accordingly, when the inside door handle D2 is open-operated once while the second link lever 33 is in the non-cancel position, the sector lever 31 in the locked position swings to the unlocked position, thereby disposing the second link lever in the cancel position. Accordingly, the latch mechanism 20 is cancelled via the second link lever 33 in the cancel position, by open-operating the inside door handle D2 once again. Subsequently, it is possible to improve the operability. The swinging shafts of the sector lever 31 and the inside handle lever 17 are formed so as to extend in parallel with the swinging shaft of the second link lever 33, at both sides of the region interposing the second link lever 33 therebetween. Therefore, even if the second link lever 33 and the sector lever 31 are swung by swinging the inside handle lever 17, the size of the inside handle lever 17 is not increased, thereby not increasing the size of the door lock apparatus.

In the first embodiment, at the inside acting end 17*a* of the inside handle lever 17 and the lock acting end 41*b* of the lock lever 41, a cover member may be provided so as to cover the portion that the housing 10 is exposed outside.

Second Embodiment

Figure 23:
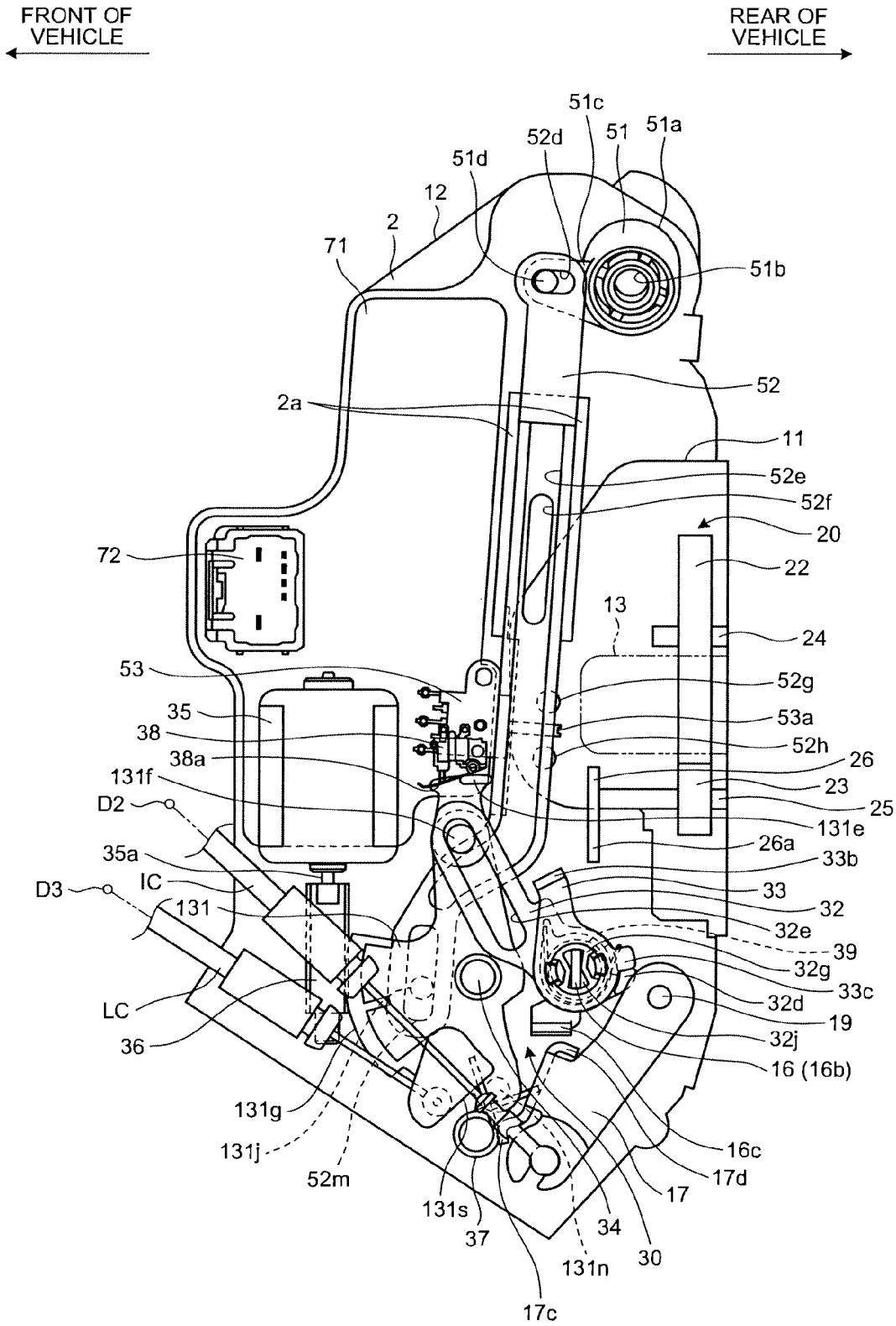
FIG. 23 is a schematic of a door lock apparatus according to a second embodiment of the present invention, viewed from the inside of a vehicle after removing a sub case.

FIG. 23 is a schematic of a door lock apparatus according to a second embodiment of the present invention, viewed from an inside of a vehicle after removing a sub case. The door lock apparatus according to the second embodiment is different from the first embodiment in that the lock lever, the double lock mechanism, and the electric motor that drives the double lock mechanism are not provided therein, and the configuration of the sector lever is different. However, the other elements are the same as those in the first embodiment. The difference will now be described in detail below. In the second embodiment, the same structures as those in the first embodiment are denoted by the same reference numerals, and descriptions thereof are omitted.

Figure 24A:
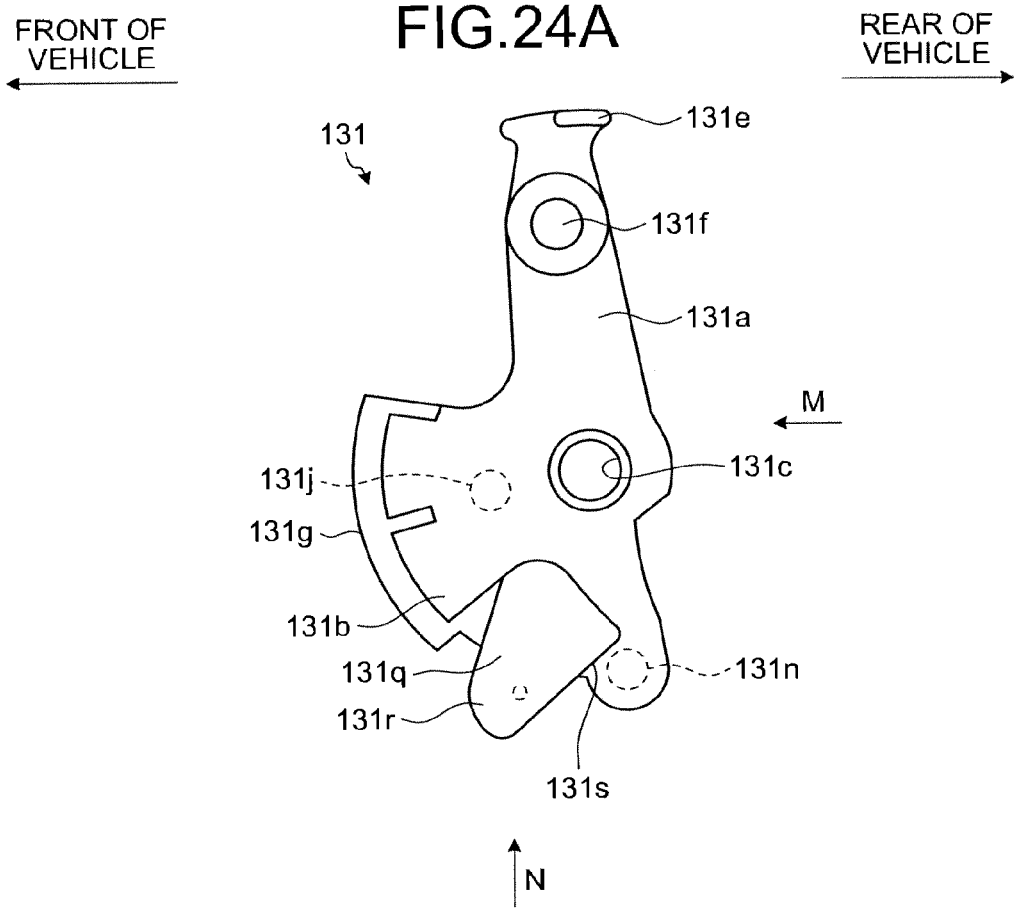
FIG. 24A is a front view of a sector lever applied to the door lock apparatus shown in FIG. 23.
Figure 24B:
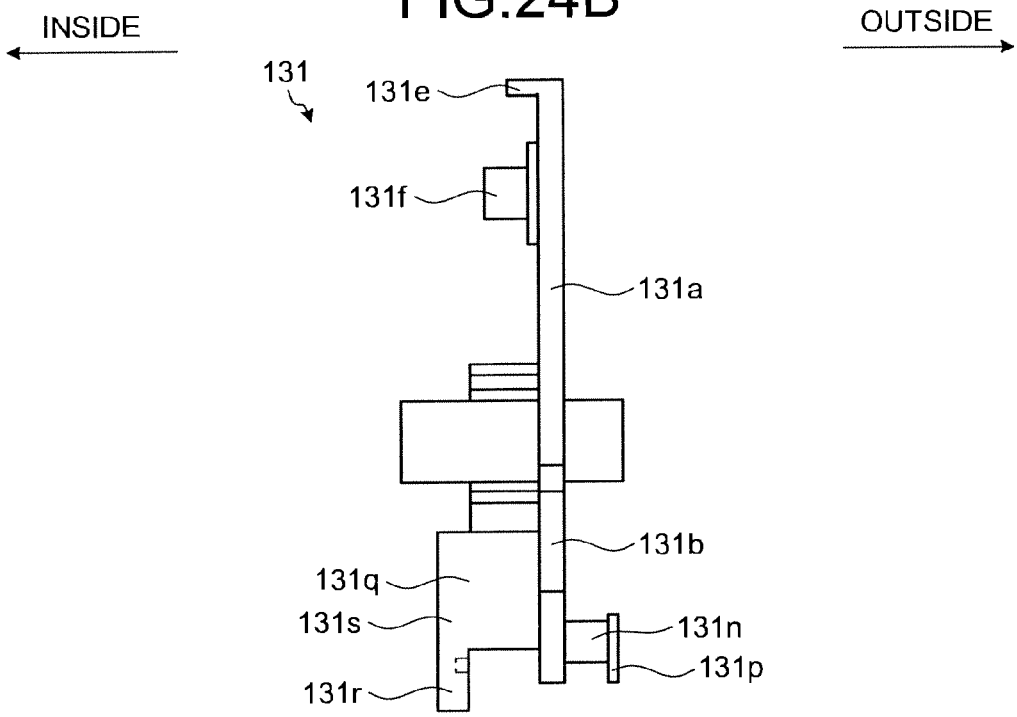
FIG. 24B is a fragmentary view of the sector lever shown in FIG. 24A taken in the direction of the arrow M.
Figure 24C:
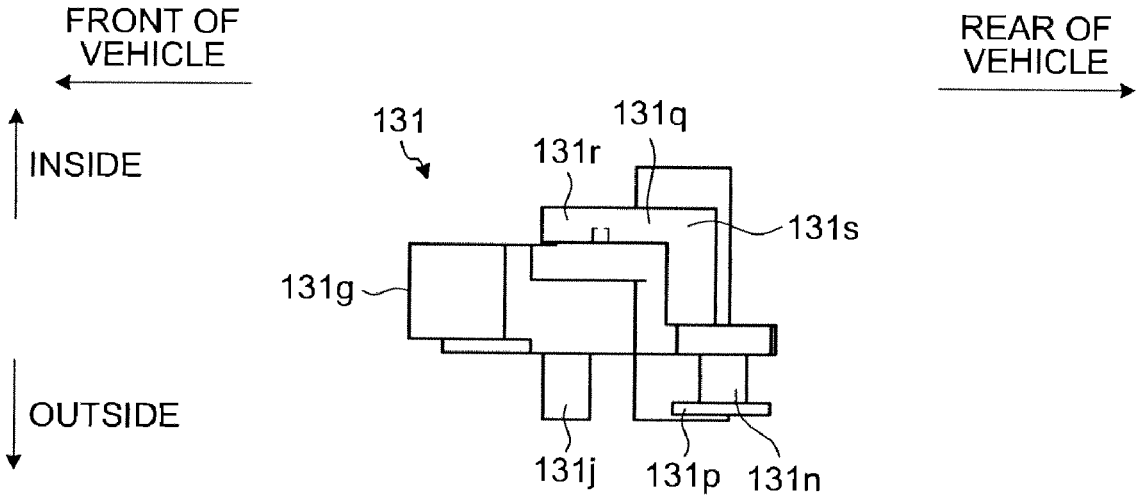
FIG. 24C is a fragmentary view of the sector lever shown in FIG. 24A taken in the direction of the arrow N.

A sector lever 131 is swingably arranged at a front region of the vehicle than the open lever 16, about the sector lever shaft 34 that extends substantially horizontally along the left-right direction of the vehicle main body. The sector lever 131 includes a sector portion that expands the opening gradually towards the front of the vehicle. The sector lever 131, as shown in FIGS. 24A, 24B, and 24C, includes a transmitting end 131*a*, an operating end 131*b*, and a sector lever shaft hole 131*c*.

The transmitting end 131*a* is a portion that extends upward from the sector lever shaft 34, and includes a block protrusion 131*e* and a connecting pin 131*f*. The block protrusion 131*e* is a portion projected towards the inside of the vehicle from the upper rim in the transmitting end 131*a*. The connecting pin 131*f* is a columnar protrusion that extends substantially horizontally along the left-right direction of the vehicle main body, from the facet positioned inside the vehicle at a region below the block protrusion 131*e* in the transmitting end 131*a*. As apparent from FIG. 23, the connecting pin 131*f* is movably inserted in the connecting groove hole 32*e* formed at the sector connecting portion 32*c* in the first link lever 32.

Figure 25:
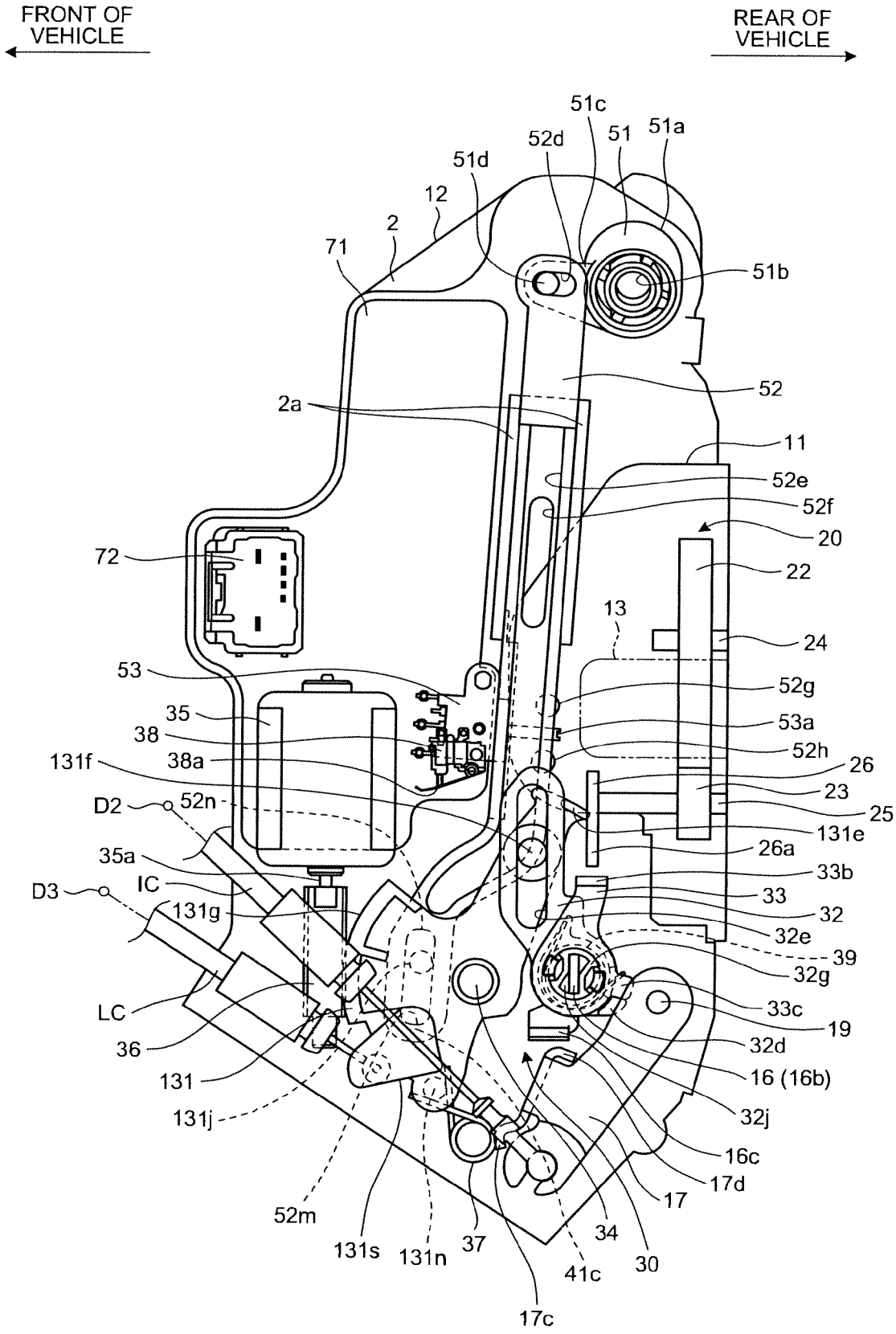
FIG. 25 is a schematic of the door lock apparatus shown in FIG. 23 when a lock mechanism is in an unlocked state.

The operating end 131*b* is a portion made in a substantially fan-shape integrally formed with a portion that extends towards the front of the vehicle from the sector lever shaft 34, and a portion that extends downward from the sector lever shaft 34. The operating end 131*b* includes a gear portion 131*g*, a key operating pin 131*j*, a lock lever portion 131*q*, and a locking pin 131*n*. The gear portion 131*g* is a gear formed at the outer peripheral surface of the operating end 131*b* in an arc, and meshed with the worm 36 fixed to the output shaft 35*a* of the electric motor 35 (see FIG. 23). The key operating pin 131*j* is a columnar protrusion that extends substantially horizontally along the left-right direction of the vehicle main body, from the facet positioned at the outside of the vehicle in the operating end 131*b*. As shown in FIG. 23, the key operating pin 131*j* is movably inserted in the sector connecting hole 52*j* formed at the sector connecting end 52*c* in the key link 52. The key operating pin 131*j*, when the transmitting end 131*a* is disposed vertically above the sector lever shaft 34, as shown in FIG. 23, is disposed at a position adjacent to the inner wall surface of the unlock portion 52*m* in the sector connecting hole 52*j* of the key link 52. When the transmitting end 131*a* is disposed at a position separated from vertically above the sector lever shaft 34, as shown in FIG. 25, the key operating pin 131*j* is disposed at a position adjacent to the inner wall surface of the lock portion 52*n* in the sector connecting hole 52*j* of the key link 52. The lock lever portion 131*q* is a portion formed so as to project towards the inside of the vehicle from the region below the key operating pin 131*j* in the operating end 131*b*. The lock lever portion 131*q* includes a lock acting end 131*r* and an inside abutting surface 131*s*.

The lock acting end 131*r* is a portion that protrudes downwards from the end positioned at a lower portion of the lock lever portion 131*q*, when the transmitting end 131*a* is disposed vertically above the sector lever shaft 34, and the protruding end is exposed to the outside through the opening 3*a* provided at the sub case 3. The lock connecting unit LC such as a link and a cable that links with the lock knob D3 arranged at the inside of the vehicle, is connected to the portion that the housing 10 is exposed to the outside in the lock acting end 131*r*. More specifically, when the lock knob D3 is locked in a predetermined manner while the lock mechanism 30 is in the unlocked state, the lock connecting unit LC is connected so as the lock lever portion 131*q* swings about the center of the sector lever shaft 34 in an anti-clockwise direction in FIG. 25. The inside abutting surface 131*s*, as shown in FIG. 23, when the lock lever portion 131*q* is disposed at the region below the sector lever shaft 34, inclines and extends gradually towards the rear of the vehicle, as moving upwards from the lower facet of the lock lever portion 131*q*. The inside abutting surface 131*s*, while the lock mechanism 30 is in the locked state, as shown in FIG. 23, is disposed in the swinging range when the lock connecting portion 17*c* of the inside handle lever 17 swings about the inside lever shaft 19. While the lock mechanism 30 is in the unlocked state, as shown in FIG. 25, the inside abutting surface 131*s* is disposed at a position separated from the lock connecting portion 17*c*.

The locking pin 131*n* is a columnar protrusion that extends substantially horizontally along the left-right direction of the vehicle main body, from the facet positioned at the outside of the vehicle at a lower region in the operating end 131*b*. A stopper 131*p* that has a larger outer diameter than the locking pin 131*n* is formed at the extended end. The sector lever shaft hole 131*c* is a hole to insert the sector lever shaft 34 therethrough.

In the second embodiment, the lock knob D3 is also retractably arranged in the inside of the vehicle, and formed so as to protrude to the inside of the vehicle only when the lock mechanism is in the unlocked state. Accordingly, it is possible to lock by pushing the lock knob D3 therein.

As shown in FIG. 23, in the second embodiment, the over-center spring 37 is also provided at the lower portion of the sector lever 131, and the lock switch 38 is arranged in the upper portion of the sector lever 131. The over-center spring 37 holds the sector lever 131 about the center of the sector lever shaft 34 via the locking pin 131*n*. More specifically, the over-center spring 37 holds the sector lever 131 either at a position where, as shown in FIG. 25, the sector lever 131 is swung about the center of the sector lever shaft 34 to the maximum clockwise extent (unlocked position), or a position where, as shown in FIG. 23, the sector lever 131 is swung about the center of the sector lever shaft 34 to the maximum anti-clockwise extent (locked position). The lock switch 38 detects whether the sector lever 131 is in a locked position, corresponding to the contact state of the block protrusion 131*e* of the sector lever 131 with respect to the detection piece 38*a*.

In the second embodiment, similar to the first embodiment, the electric motor 35, the lock switch 38, and the key switch 53, as shown in FIG. 23, are also connected to the circuit substrate 71 arranged inside the lock mechanism accommodating portion 12. The connector 72 that supplies power to each motor and each switch is arranged at the circuit substrate 71.

In the second embodiment, with the lock mechanism 30 formed similarly to the first embodiment, the state shown in FIG. 25 is the unlocked state. In the unlocked state, the sector lever 131 is disposed in the unlocked position and the ratchet driving portion 33*b* of the second link lever (link lever of the present invention) is disposed vertically above the connecting tool 32*g* mounted on the first link lever 32 (cancel position). Accordingly, the ratchet driving portion 33*b* is closely opposed to the lower facet of the abutting portion 26*a* in the ratchet lever 26. Therefore, when the outside door handle D1 is open-operated from this state, and the link main body 32*a* of the first link lever 32 moves upwards by the rotation of the open lever 16, the ratchet driving portion 33*b* of the second link lever 33 abuts to the abutting portion 26*a* of the ratchet lever 26 in the latch mechanism 20, thereby moving the latch mechanism 20 upwards. As a result, even if the latch mechanism 20 is in the latched state, the latched state is cancelled, thereby enabling to move and open the door D with respect to the vehicle main body.

From the unlocked state shown in FIG. 25, when the electric motor 35 is driven and the worm 36 is suitably rotated in any direction, the sector lever 131 swings about the sector lever shaft 34 in an anti-clockwise direction. As a result, the first link lever 32 engaged via the connecting pin 131*f* and the second link lever 33 that abuts to the lever abutting portion 32*d* swing about the fitting hole 32*j* in an anti-clockwise direction. Accordingly, the lock mechanism 30 is turned in the locked state shown in FIG. 23.

In the locked state, the sector lever 131 is disposed in the locked position, and the ratchet driving portion 33*b* of the second link lever 33 deviates from the position opposed to the lower facet of the abutting portion 26*a* in the ratchet lever 26 (non-cancel position). Accordingly, even if the outside door handle D1 is open-operated, and the link main body 32*a* of the first link lever 32 moves upwards by the rotation of the open lever 16, the ratchet driving portion 33*b* does not abut to the abutting portion 26*a* of the ratchet lever 26 in the latch mechanism 20. As a result, the open-operation of the outside door handle D1 is invalidated, and when the latch mechanism 20 is in the latched state, the latched state will be maintained. Subsequently, the door D is maintained in the closed position with respect to the vehicle main body.

From the locked state shown in FIG. 23, when the electric motor 35 is driven and the worm 36 is suitably rotated in any direction, the sector lever 131 swings about the sector lever shaft 34 in a clockwise direction. As a result, the first link lever 32 engaged via the connecting pin 131*f* and the second link lever 33 biased by the panic spring 39 rotate about the fitting hole 32*j* in a clockwise direction. Accordingly, the lock mechanism 30 returns again to the unlocked state shown in FIG. 25.

It is not always necessary to drive the electric motor 35 to shift the lock mechanism 30 in the unlocked state shown in FIG. 25 to the locked state shown in FIG. 23, but it is also possible by locking the lock knob D3. In other words, from the unlocked state shown in FIG. 25, when the lock lever portion 131*q* of the sector lever 131 is swung about the center of the sector lever shaft 34 in an anti-clockwise direction, by locking the lock knob D3, the sector lever 131 swings about the sector lever shaft 34 in an anti-clockwise direction, while suitably rotating the worm 36. As a result, the sector lever 131 is disposed in the locked position, and the first link lever 32 engaged via the connecting pin 131*f* and the second link lever 33 that abuts to the lever abutting portion 32*d* swing about the fitting hole 32*j* in an anti-clockwise direction. Accordingly, the lock mechanism 30 is turned in the locked state shown in FIG. 23.

When the inside door handle D2 is open-operated from the unlocked state shown in FIG. 25, the open connecting portion 17*d* of the inside handle lever 17 moves upwards. Accordingly, the first link lever 32 and the second link lever 33 also move upwards, via the pressure-receiving portion 16*c* of the open lever 16. Therefore, the second link lever 33 abuts to the abutting portion 26*a* of the ratchet lever 26 in the latch mechanism 20, thereby canceling the latched state. In other words, the door D can be opened and moved by the open-operation of the inside door handle D2.

In the locked state shown in FIG. 23, the inside abutting surface 131*s* provided at the lock lever portion 131*q* of the sector lever 131 is disposed in the swinging region of the lock connecting portion 17*c* in the inside handle lever 17. When the inside door handle D2 is open-operated from this state, the first link lever 32 and the second link lever 33 also move upwards, because the open connecting portion 17*d* moves in the inside handle lever 17. The lock connecting portion 17*c* also abuts to the inside abutting surface 131*s* of the sector lever 131, thereby swinging the sector lever 131 about the center of the sector lever shaft 34 in a clockwise direction. When the inside door handle D2 is open-operated once, the sector lever 131 swings to the state shown in FIG. 27 from the state shown in FIG. 23, via the state shown in FIG. 26. The operation will now be described in detail.

Figure 26:
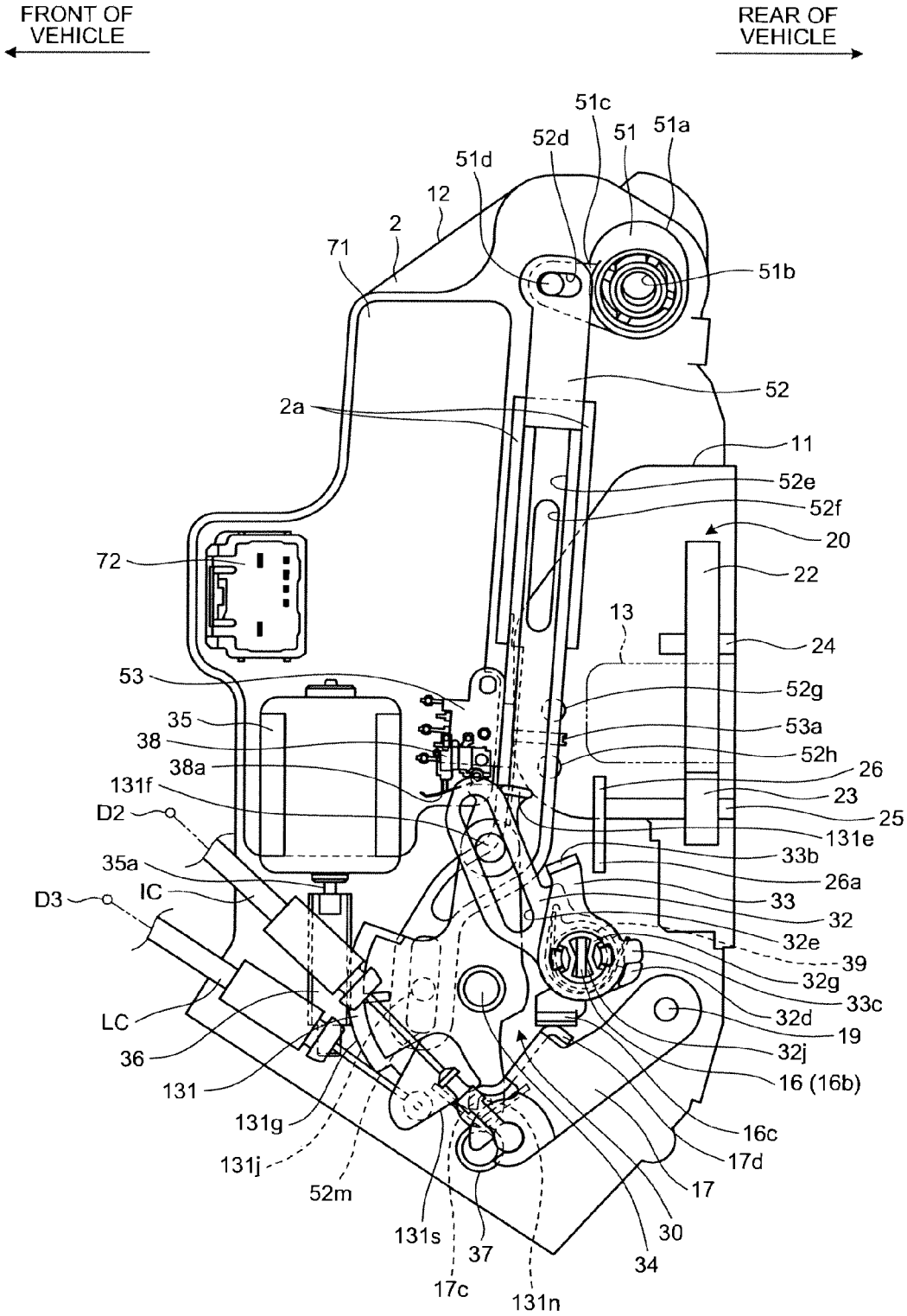
FIG. 26 is a schematic of a state when an inside door handle is open-operated in the state shown in FIG. 23.

When the open connecting portion 17*d* of the inside handle lever 17 moves upwards, as shown in FIG. 26, the first link lever 32 and the second link lever 33 also move upwards, via the pressure-receiving portion 16*c* of the open lever 16. When the sector lever 131 swings about the center of the sector lever shaft 34 in a clockwise direction, the connecting pin 131*f* also moves to the rear of the vehicle. Accordingly, the first link lever 32 swings in a clockwise direction in FIG. 23.

Figure 27:
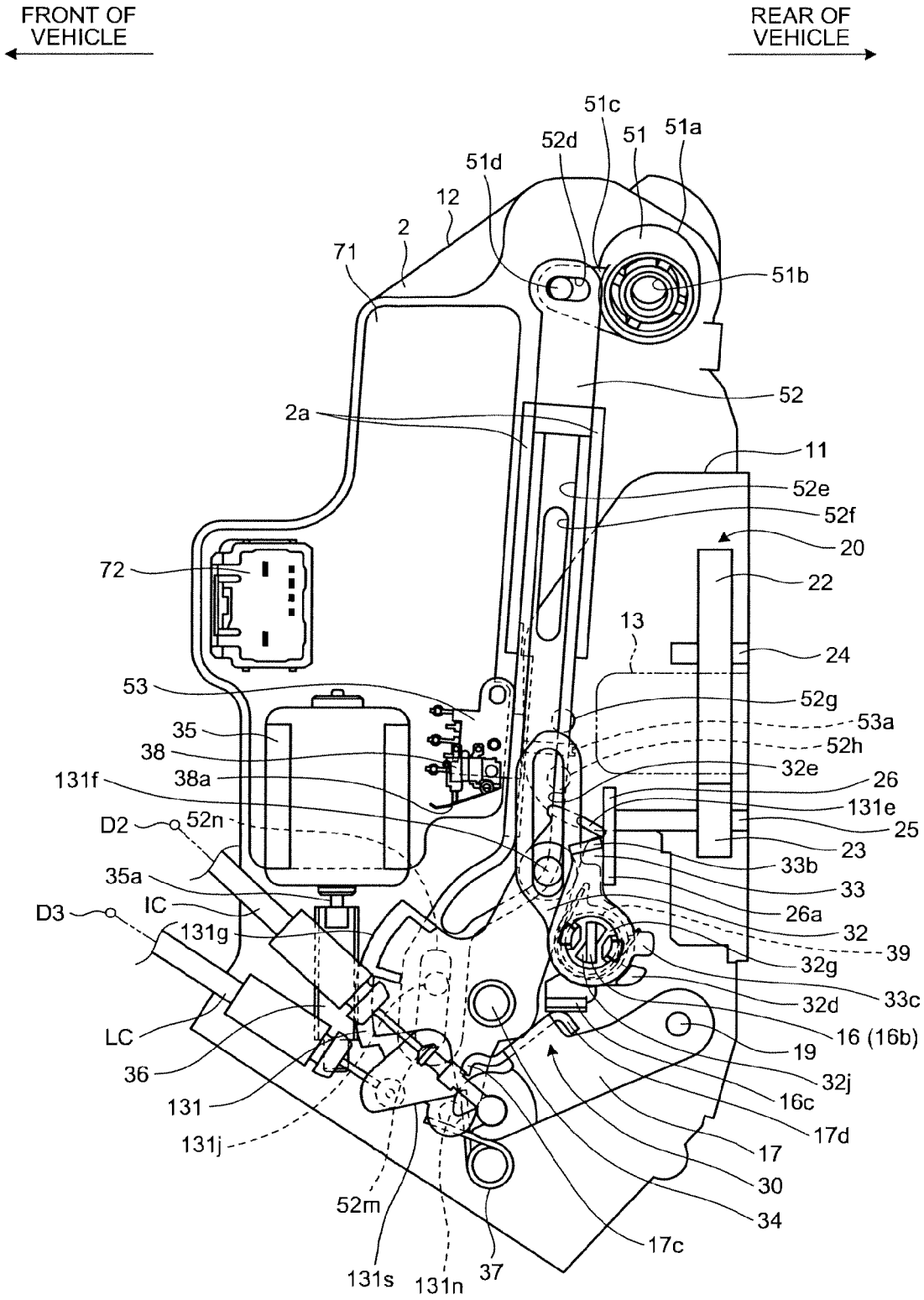
FIG. 27 is a schematic of a state when the inside door handle is continuously open-operated in the state shown in FIG. 26.

From the state shown in FIG. 26, when the open connecting portion 17*d* of the inside handle lever 17 further moves upwards, as shown in FIG. 27, the first link lever 32 and the second link lever 33 also move upwards via the pressure-receiving portion 16*c* of the open lever 16. From the state shown in FIG. 26, when the sector lever 131 further swings about the center of the sector lever shaft 34 in a clockwise direction, while suitably rotating the worm 36, the sector lever 131 is disposed in the unlocked position. When the sector lever 131 is swung further, the connecting pin 131*f* moves towards the rear of the vehicle, thereby also swinging the first link lever 32 in a clockwise direction in FIG. 26. At this time, as shown in FIG. 27, the ratchet driving portion 33*b* of the second link lever 33 abuts to the abutting portion 26*a* of the ratchet lever 26 from the front side of the vehicle. Accordingly, the first link lever 32 cancels the abutting state with the locking portion 33*c* against the elastic restoring force of the panic spring 39, thereby swinging in a clockwise direction in FIG. 26.

When the open-operating force of the inside door handle D2 is removed from the state shown in FIG. 27, the open lever 16 moves the open operating end 16*b* and the pressure-receiving portion 16*c* downwards, by the elastic restoring force of the open lever spring (not shown). Accordingly, the first link lever 32 and the second link lever 33 also move downwards. When the open operating end 16*b* and the pressure-receiving portion 16*c* move downwards, as shown in FIG. 25, the lower facet of the pressure-receiving portion 16*c* is disposed so as to closely oppose to the open connecting portion 17*d* of the inside handle lever 17 again. When the first link lever 32 and the second link lever 33 move downwards, as shown in FIG. 27, the abutting state between the ratchet driving portion 33*b* of the second link lever 33 and the abutting portion 26*a* of the ratchet lever 26 is subsequently cancelled. Accordingly, the second link lever 33 moves the locking portion 33*c* so as to abut to the lever abutting portion 32*d* of the first link lever 32 again, by the elastic restoring force of the panic spring 39. With the movement of the second link lever 33, as shown in FIG. 25, the ratchet driving portion 33*b* of the second link lever 33 is disposed vertically above the connecting tool 32*g* mounted on the first link lever 32 (cancel position). Accordingly, the ratchet driving portion 33*b* is closely opposed to the lower facet of the abutting portion 26*a* in the ratchet lever 26, thereby turning the lock mechanism 30 in the unlocked state.

In the state shown in FIG. 25, when the inside door handle D2 is open-operated, the open connecting portion 17*d* of the inside handle lever 17 moves upwards. Accordingly, the first link lever 32 and the second link lever 33 also move upwards via the pressure-receiving portion 16*c* of the open lever 16. At this time, the inside abutting surface 131*s* provided at the lock lever portion 131*q* of the sector lever 131 is disposed at a position separated from the lock connecting portion 17*c* in the inside handle lever 17, thereby not abutting to the lock connecting portion 17*c*. Therefore, the second link lever 33 abuts to the abutting portion 26*a* of the ratchet lever 26 in the latch mechanism 20, thereby canceling the latched state. In other words, the door D can be opened and moved by the open-operation of the inside door handle D2 (so-called double action mechanism).

As shown in FIG. 27, the state that the ratchet driving portion 33*b* of the second link lever 33 abuts to the abutting portion 26*a* of the ratchet lever 26 also occurs, in the locked state shown in FIG. 23, when the outside door handle D1 is open-operated and the lock mechanism 30 is switched to the unlocked state by driving the electric motor 35. In the locked state shown in FIG. 23, when the outside door handle D1 is open-operated, the first link lever 32 and the second link lever 33 move upwards by the rotation of the open lever 16, without the ratchet driving portion 33*b* of the second link lever 33 moving the abutting portion 26*a* of the ratchet lever 26 in the latch mechanism 20 upward. In this state, when the electric motor 35 is driven and the worm 36 is suitably rotated in any direction, the sector lever 131 swings about the sector lever shaft 34 in a clockwise direction. Because the sector lever 131 swings, the connecting pin 131*f* moves towards the rear of the vehicle. Accordingly, the first link lever 32 also moves in a clockwise direction in FIG. 23. At this time, the ratchet driving portion 33*b* of the second link lever 33 abuts to the abutting portion 26*a* of the ratchet lever 26 from the front side of the vehicle. Subsequently, the first link lever 32 cancels the abutting state with the locking portion 33*c*, against the elastic restoring force of the panic spring 39, thereby turning in the state shown in FIG. 27.

In this state, when the open-operating force of the outside door handle D1 is removed, the open lever 16 moves the open operating end 16*b* and the pressure-receiving portion 16*c* downward, by the elastic restoring force of the open lever spring (not shown). Accordingly, the first link lever 32 and the second link lever 33 also move downwards. When the first link lever 32 and the second link lever 33 move downwards, as shown in FIG. 25, the abutting state between the ratchet driving portion 33*b* of the second link lever 33 and the abutting portion 26*a* of the ratchet lever 26 is subsequently cancelled. Accordingly, the second link lever 33 moves the locking portion 33*c* again so as to abut with the lever abutting portion 32*d* of the first link lever 32, by the elastic restoring force of the panic spring 39. When the second link lever 33 moves, as shown in FIG. 25, the ratchet driving portion 33*b* of the second link lever 33 is disposed vertically above the connecting tool 32*g* mounted on the first link lever 32 (cancel position). Subsequently, the ratchet driving portion 33*b* is closely opposed to the lower facet of the abutting portion 26*a* in the ratchet lever 26, thereby turning the lock mechanism 30 in the unlocked state.

When the outside door handle D1 is open-operated again from the state shown in FIG. 25, and the link main body 32*a* of the first link lever 32 moves upwards by the rotation of the open lever 16, the ratchet driving portion 33*b* of the second link lever 33 abuts to the abutting portion 26*a* of the ratchet lever 26 in the latch mechanism 20, thereby moving the latch mechanism 20 upwards. As a result, even if the latch mechanism 20 is in the latched state, the latched state is cancelled. Accordingly, the door D can be opened and moved with respect to the vehicle main body.

It is not always necessary to drive the electric motor 35 or locking the lock knob D3, to shift the lock mechanism 30 in the unlocked state shown in FIG. 25 to the locked state shown in FIG. 23, but it is also possible by fastening the key cylinder KC. In other words, from the unlocked state shown in FIG. 25, when the key lever 51 is rotated about the center of the rotation concave portion 51*b* in an anti-clockwise direction by the key-operation of the key cylinder KC, the key link 52 engaged via the lever pin 51*d* slidably moves downwards along the longitudinal direction of the pair of guide bodies provided in the main case 2. When the key link 52 slidably moves downwards along the longitudinal direction of the pair of guide bodies 2*a* provided in the main case 2, the inner wall surface of the lock portion 52*n* moves the key operating pin 131*j* of the sector lever 131 downwards in the sector connecting hole 52*j*. At this time, the lock recognizing protrusion 52*g* presses the detection piece 53*a* of the key switch 53 downwards. Accordingly, the key switch 53 detects the key operation, in other words, a fastening operation of the key cylinder KC from the movement of the key link 52. When the key operating pin 131*j* of the sector lever 131 moves downwards, the sector lever 131 swings about the sector lever shaft 34 in an anti-clockwise direction, while suitably rotating the worm 36. As a result, the first link lever 32 engaged via the connecting pin 131*f* and the second link lever 33 that abuts to the lever abutting portion 32*d* swing about the fitting hole 32*j* in an anti-clockwise direction. Accordingly, the lock mechanism 30 is turned in the locked state shown in FIG. 23.

It is not always necessary to drive the electric motor 35 to shift the lock mechanism 30 in the locked state shown in FIG. 23 to the unlocked state shown in FIG. 25, but it is also possible by unfastening the key cylinder KC. In other words, from the locked state shown in FIG. 23, when the key lever 51 is rotated about the center of the rotation concave portion 51*b* in a clockwise direction, by the key operation of the key cylinder KC, the key link 52 engaged via the lever pin 51*d* slidably moves upwards along the longitudinal direction of the pair of guide bodies 2*a* provided in the main case 2. When the key link 52 slidably moves upwards along the longitudinal direction of the pair of guide bodies 2*a* provided in the main case 2, the inner wall surface of the unlock portion 52*m* moves the key operating pin 131*j* of the sector lever 131 upwards in the sector connecting hole 52*j*. At this time, because the unlock recognizing protrusion 52*h* presses the detection piece 53*a* of the key switch 53 upwards, the key switch 53 detects the key operation, in other words, an unfastening operation of the key cylinder KC from the movement of the key link 52.

When the key operating pin 131*j* of the sector lever 131 moves upwards, the sector lever 131 swings about the sector lever shaft 34 in a clockwise direction, while suitably rotating the worm 36. As a result, the first link lever 32 engaged via the connecting pin 131*f* and the second link lever 33 biased by the panic spring 39 swing about the fitting hole 32*j* in a clockwise direction. Accordingly, the lock mechanism 30 is turned in the unlocked state shown in FIG. 25.

With the door lock apparatus according to the second embodiment formed as the above, similar to the first embodiment, at both sides of the region interposing the second link lever 33 therebetween, includes the sector lever shaft 34 and the inside lever shaft 19 that extend in parallel with the swinging shaft of the second link lever 33. The door lock apparatus according to the second embodiment also includes the inside handle lever 17 swingably arranged between the unlocked position and the locked position about the sector lever shaft 34, and also swingably arranged about the inside lever shaft 19. The inside handle lever 17, when the inside door handle D2 arranged inside the vehicle while the second link lever 33 is positioned in the cancel position, moves the second link lever 33 upwards by swinging about the center of the inside lever shaft 19. When the inside door handle D2 is open-operated while the second link lever 33 is disposed in the non-cancel position, the inside handle lever 17 swings the sector lever 131 in the locked position to the unlocked position about the center of the sector lever shaft 34, by swinging about the center of the inside lever shaft 19. Accordingly, when the inside door handle D2 is open-operated once, while the second link lever 33 is in the non-cancel position, the sector lever 131 in the locked position swings to the unlocked position, thereby disposing the second link lever in the cancel position. Accordingly, the latch mechanism 20 is cancelled via the second link lever 33 in the cancel position, by open-operating the inside door handle D2 once again. Subsequently, it is possible to improve the operability. The swinging shafts of the sector lever 131 and the inside handle lever 17 are formed, similar to those in the first embodiment, so as to extend in parallel with the swinging shaft of the second link lever 33, at both sides of the region interposing the second link lever 33 therebetween. Therefore, even if the second link lever 33 and the sector lever 131 are swung by swinging the inside handle lever 17, the size of the inside handle lever 17 is not increased, thereby not increasing the size of the door lock apparatus.

In the second embodiment, at the inside acting end 17*a* of the inside handle lever 17 and the lock acting end 131*r* of the sector lever 131, a cover member may also be provided so as to cover the portion that the housing 10 is exposed to the outside.

According to the present invention, a door lock apparatus includes a latch mechanism that restricts movement of a door in an open direction by latching when the door is in a closed position with respect to a vehicle main body; a link lever that swings between a cancel position and a non-cancel position; a sector lever shaft and an inside lever shaft that are disposed on both sides of the link lever and extend in parallel with a swinging shaft of the link lever; a sector lever that is swingably disposed between an unlocked position and a locked position about the sector lever shaft; and an inside handle lever that is swingably disposed about the inside lever shaft. The link lever allows movement of the door in the open direction by cancelling a latched state of the latch mechanism when moved upwards while being disposed in the cancel position, and maintains the latched state of the latch mechanism when moved upwards while being disposed in the non-cancel position. The sector lever moves the link lever to the cancel position while in the unlocked position, and moves the link lever to the non-cancel position while in the locked position. The inside handle lever moves the link lever upward by swinging about a center of the inside lever shaft when an inside door handle arranged inside a vehicle is open-operated while the link lever is being positioned in the cancel position, and swings the sector lever in the locked position to the unlocked position by swinging about the center of the inside lever shaft when the inside door handle is open-operated while the link lever is being positioned in the non-cancel position. Therefore, when the inside door handle is open-operated once while the link lever is in the non-cancel position, the sector lever in the locked position swings to the unlocked position, thereby disposing the link lever in the cancel position. Accordingly, by open-operating the inside door handle once again, the latch mechanism is cancelled via the link lever in the cancel position. Subsequently, it is possible to improve the operability. The swinging shafts of the sector lever and the inside handle lever are formed so as to extend in parallel with the swinging shaft of the link lever, at both sides of the region interposing the link lever therebetween. Therefore, even if the link lever and the sector lever are swung by swinging the inside handle lever, the size of the inside handle lever is not increased, thereby not increasing the size of the door lock apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2008-082190, filed Mar. 26, 2008, which is incorporated herein by reference in its entirety.

What is claimed is:

1. A door lock apparatus comprising:

a latch mechanism that restricts movement of a door in an open direction by latching when the door is in a closed position with respect to a vehicle main body, the latch mechanism comprising a ratchet lever;

a first link lever that includes a connecting groove hole that is formed as a slit opening;

a second link lever that swings between a cancel position and a non-cancel position, the second link lever allowing movement of the door in the open direction by cancelling a latched state of the latch mechanism when moved upwards while being disposed in the cancel position, the second link lever maintaining the latched state of the latch mechanism when moved upwards while being disposed in the non-cancel position;

a connecting tool that connects the first link lever and the second link lever;

a sector lever shaft and an inside lever shaft that are disposed on both sides of the second link lever and extend in parallel with a swinging shaft of the second link lever;

a sector lever that is swingably disposed between an unlocked position and a locked position about the sector lever shaft, the sector lever configured to move the second link lever to the cancel position while in the unlocked position, and configured to move the second link lever to the non-cancel position while in the locked position, the sector lever comprising a connecting pin inserted into the connecting groove hole of the first link lever; and an inside handle lever that is swingably disposed about the inside lever shaft, the inside handle lever configured to move the second link lever upward by swinging about a center of the inside lever shaft when an inside door handle arranged inside a vehicle is open-operated while the second link lever is positioned in the cancel position, and configured to swing the sector lever from the locked position to the unlocked position by swinging about the center of the inside lever shaft when the inside door handle is open-operated while the second link lever is positioned in the non-cancel position, wherein a shaft of the second link lever is disposed below the ratchet lever with respect to a top of the vehicle main body, wherein in the cancel position, a ratchet driving portion of the second link lever is disposed below the ratchet lever with respect to the top of the vehicle main body, wherein in the non-cancel position, the ratchet driving portion of the second link lever is disposed out of alignment with the ratchet lever; the connecting pin of the sector lever is disposed father away from the ratchet lever than in the cancel position; and the sector lever is configured in the locked position, defined by a counter-clockwise rotation of the sector lever from the unlocked position.

2. The door lock apparatus of claim 1, wherein the slit opening includes two parallel sides and two half-circle ends.

3. A door lock apparatus comprising:

a latch mechanism that restricts movement of a door in an open direction by latching when the door is in a closed position with respect to a vehicle main body, the latch mechanism comprising a ratchet lever;

a first link lever that includes a connecting groove hole that is formed as a slit opening;

a second link lever that swings between a cancel position and a non-cancel position, the second link lever allowing movement of the door in the open direction by cancelling a latched state of the latch mechanism when moved upwards while being disposed in the cancel position, the second link lever maintaining the latched state of the latch mechanism when moved upwards while being disposed in the non-cancel position;

a sector lever shaft and an inside lever shaft that are disposed on both sides of the second link lever and extend in parallel with a swinging shaft of the second link lever;

a sector lever that is swingably disposed between an unlocked position and a locked position about the sector lever shaft, the sector lever configured to move the second link lever to the cancel position while in the unlocked position, and configured to move the second link lever to the non-cancel position while in the locked position, the sector lever comprising a connecting pin inserted into the connecting groove hole of the first link lever; and an inside handle lever that is swingably disposed about the inside lever shaft, the inside handle lever configured to move the second link lever upward by swinging about a center of the inside lever shaft when an inside door handle arranged inside a vehicle is open-operated while the second link lever is positioned in the cancel position, and configured to swing the sector lever from the locked position to the unlocked position by swinging about the center of the inside lever shaft when the inside door handle is open-operated while the second link lever is positioned in the non-cancel position, wherein a shaft of the second link lever is disposed below the ratchet lever with respect to a top of the vehicle main body, wherein in the cancel position, a ratchet driving portion of the second link lever is disposed below the ratchet lever with respect to the top of the vehicle main body, wherein in the non-cancel position, the ratchet driving portion of the second link lever is disposed out of alignment with the ratchet lever; the connecting pin of the sector lever is disposed father away from the ratchet lever than in the cancel position; and the sector lever is configured in the locked position, defined by a counter-clockwise rotation of the sector lever from the unlocked position.

4. The door lock apparatus of claim 3, wherein the slit opening includes two parallel sides and two half-circle ends.

5. The door lock apparatus of claim 1, wherein the latch mechanism includes a latch and a ratchet, the ratchet includes the ratchet lever, and the ratchet and the ratchet lever rotate integrally about a ratchet shaft.

6. The door lock apparatus of claim 1, wherein the connecting tool comprises a substantially cylindrical main body mounted on the first link lever, and the second link lever includes a connecting tool main body hole to receive the substantially cylindrical main body.

7. The door lock apparatus of claim 1, further comprising a motor and a worm to move the sector lever between the unlocked position and the locked position.

8. The door lock apparatus of claim 1, further comprising a lock knob, wherein the lock knob is configured to move the sector lever from the unlocked position to the locked position.

9. The door lock apparatus of claim 3, wherein the latch mechanism includes a latch and a ratchet, the ratchet includes the ratchet lever, and the ratchet and the ratchet lever rotate integrally about a ratchet shaft.

10. The door lock apparatus of claim 3, further comprising a motor and a worm to move the sector lever between the unlocked position and the locked position.

11. The door lock apparatus of claim 3, further comprising a lock knob, wherein the lock knob is configured to move the sector lever from the unlocked position to the locked position.

* * * * *